US012642368B2

(12) United States Patent
Coronado et al.

(10) Patent No.: US 12,642,368 B2
(45) Date of Patent: Jun. 2, 2026

(54) REFRIGERATED MERCHANDISER

(71) Applicant: Hussmann Corporation, Bridgeton, MO (US)

(72) Inventors: Felix Coronado, Danville, CA (US); Al M. Arrosagaray, Owasso, OK (US); Robert Mullen, Anaheim, CA (US); Alex J. Evdokimoff, Murrieta, CA (US)

(73) Assignee: Hussmann Corporation, Bridgeton, MO (US)

( * ) Notice: Subject to any disclaimer, the term of this patent is extended or adjusted under 35 U.S.C. 154(b) by 265 days.

(21) Appl. No.: 18/339,041

(22) Filed: Jun. 21, 2023

(65) Prior Publication Data

US 2023/0414013 A1 Dec. 28, 2023

Related U.S. Application Data

(60) Provisional application No. 63/354,508, filed on Jun. 22, 2022.

(51) Int. Cl.
*A47F 3/04* (2006.01)

(52) U.S. Cl.
CPC ..... *A47F 3/0447* (2013.01); *A47F 3/0456* (2013.01); *A47F 2003/046* (2013.01)

(58) Field of Classification Search
CPC . A47F 3/0456; A47F 3/0486; A47F 2003/046
See application file for complete search history.

(56) References Cited

U.S. PATENT DOCUMENTS 3,392,543 A 7/1968 Miller
4,489,995 A 12/1984 Barr
(Continued)

FOREIGN PATENT DOCUMENTS

AU 2014274571 A1 * 1/2015
CA 2886151 A1 11/2015
(Continued)

OTHER PUBLICATIONS

Translated_Urakawa (Year: 1998).*
(Continued)

*Primary Examiner* — Jerry-Daryl Fletcher
*Assistant Examiner* — Samba Nmn Gaye
(74) *Attorney, Agent, or Firm* — Michael Best & Friedrich LLP

(57) ABSTRACT

A refrigerated merchandiser including a case including case structure defining a product display area, a refrigeration system supported by the case to condition the product display area, a first refrigerated section including a first product display arrangement supported by the case structure and positioned in a first portion of the product display area, and a second refrigerated section including a second product display arrangement that is supported by the case structure and positioned in a second portion of the product display area. The refrigeration system communicates with the first and the second portions of the product display area to respectively maintain the same within a predetermined temperature range. One or both the first product display arrangement or the second product display arrangement is replaceable, without the use of tools, by a third product display arrangement that is different from the first product display arrangement and the second display arrangement.

20 Claims, 28 Drawing Sheets

(56) References Cited

U.S. PATENT DOCUMENTS

| | | | | |
|---|---|---|---|---|
| 5,743,098 | A | 4/1998 | Behr | |
| 9,084,496 | B1 * | 7/2015 | Neelagantan | A47F 3/0482 |
| 9,289,064 | B2 | 3/2016 | Lamontagne et al. | |
| 12,096,867 | B2 | 9/2024 | Navarro et al. | |
| 2012/0047933 | A1 * | 3/2012 | McGowan | A47F 3/0456 206/557 |
| 2014/0263126 | A1 | 9/2014 | Lamontagne et al. | |
| 2015/0101359 | A1 | 4/2015 | Iyengar | |
| 2016/0081493 | A1 | 3/2016 | Wood et al. | |
| 2018/0352974 | A1 * | 12/2018 | Archbold | A47F 3/0469 |
| 2021/0131117 | A1 * | 5/2021 | Warner | A47G 25/06 |
| 2024/0285096 | A1 * | 8/2024 | Lucas | A47F 3/005 |

FOREIGN PATENT DOCUMENTS

| | | | |
|---|---|---|---|
| EP | 0089556 | A1 | 9/1983 |
| EP | 2092861 | A1 | 8/2009 |
| GB | 2549950 | A | 11/2017 |
| JP | H10281637 | A * | 10/1998 |
| WO | 2011121284 | A2 | 10/2011 |
| WO | 2018153475 | A1 | 8/2018 |

OTHER PUBLICATIONS

Translated_Navarro (Year: 2015).*
New Zealand Patent Office Action for Application No. 801178 dated Apr. 30, 2025 (4 pages).

* cited by examiner

SECTION C-C

SECTION E-E

REFRIGERATED MERCHANDISER

CROSS-REFERENCE TO RELATED APPLICATIONS

This application claims priority to U.S. Provisional Patent Application No. 63/354,508 filed on Jun. 22, 2022, the entire content of which is hereby incorporated by reference.

BACKGROUND

The present invention relates to a refrigerated merchandiser, and more particularly, the present invention relates to a refrigerated merchandiser that can be converted from a refrigerated merchandiser of a first type to a refrigerated merchandiser of a second type.

In conventional practice, commercial businesses such as supermarkets and convenience stores are equipped with various refrigerated merchandisers including product display areas that support and display product (fresh or frozen product, beverages, condiments, dry goods, etc.). Conventional refrigerated merchandisers are assembled using tools and fasteners. That is, conventional refrigerated merchandisers include case structure and product display arrangements that have shelves and other display structure that are couplable to and removable from the case structure using fasteners. Accordingly, a user must use tools to assemble and disassemble conventional merchandisers. The use of fasteners increases the number of parts of conventional refrigerated merchandisers. Also, the use of fasteners and tools increase the complexity of assembly. Moreover, the increased number of parts and complexity makes it more difficult to use the same case structure for refrigerated merchandisers having different configurations.

Aspects of the invention will become apparent by consideration of the detailed description and accompanying drawings.

SUMMARY

According to an exemplary construction, the invention includes a refrigerated merchandiser including a case including case structure defining a product display area and a refrigeration system supported by the case to condition the product display area. A first refrigerated section includes a first product display arrangement supported by the case structure and positioned in a first portion of the product display area. The refrigeration system is in communication with the first portion of the product display area to maintain the first portion of the product display area within a predetermined temperature range. A second refrigerated section includes a second product display arrangement that is supported by the case structure and that is positioned in a second portion of the product display area. The refrigeration system is in communication with the second portion of the product display area to maintain the second portion of the product display area within the predetermined temperature range. One or both the first product display arrangement or the second product display arrangement is replaceable by a third product display arrangement that is different from the first product display arrangement and the second display arrangement.

According to another exemplary construction, the invention includes a refrigerated merchandiser with a case that including a base, a rear wall, and a canopy at least partially defining a product display area having a first refrigerated section and a second refrigerated section laterally adjacent the first refrigerated section. A refrigeration system is coupled to the case and including a first evaporator and a second evaporator configured to selectively condition the product display area. The first refrigerated section includes a first product display arrangement that is at least partially supported by the rear wall. The first evaporator is in airflow communication with the first refrigerated section to maintain the first refrigerated section within a predetermined temperature range. The second refrigerated section includes a second product display arrangement that is at least partially supported by the rear wall. The second evaporator is in airflow communication with the second refrigerated section to maintain the second refrigerated section within the predetermined temperature range. One or both of the first product display arrangement and the second product display arrangement is replaceable with a third product display arrangement different from the first product display arrangement and the second product display arrangement, the third product display arrangement at least partially supported by the rear wall.

According to another exemplary construction, the invention includes a refrigerated merchandiser with a case including a base and a rear wall at least partially defining a product display area. A refrigeration system coupled to the case and in communication with a first portion of the product display area and a second portion of the product display area. The refrigeration system includes one or more heat exchangers to maintain the first portion of the product display area within a predetermined temperature range and the second portion of the product display area within the predetermined temperature range. A first shelf is supported by the rear wall and positioned in the first portion of the product display area and a second shelf is supported by the rear wall and positioned in the second portion of the product display area. The first shelf is removable from the rear wall and replaceable with a counter assembly supported by the base and the rear wall. The countertop assembly is attached to the base and the rear wall, in some embodiments without fasteners and without tools.

DETAILED DESCRIPTION

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

Figure 1A:
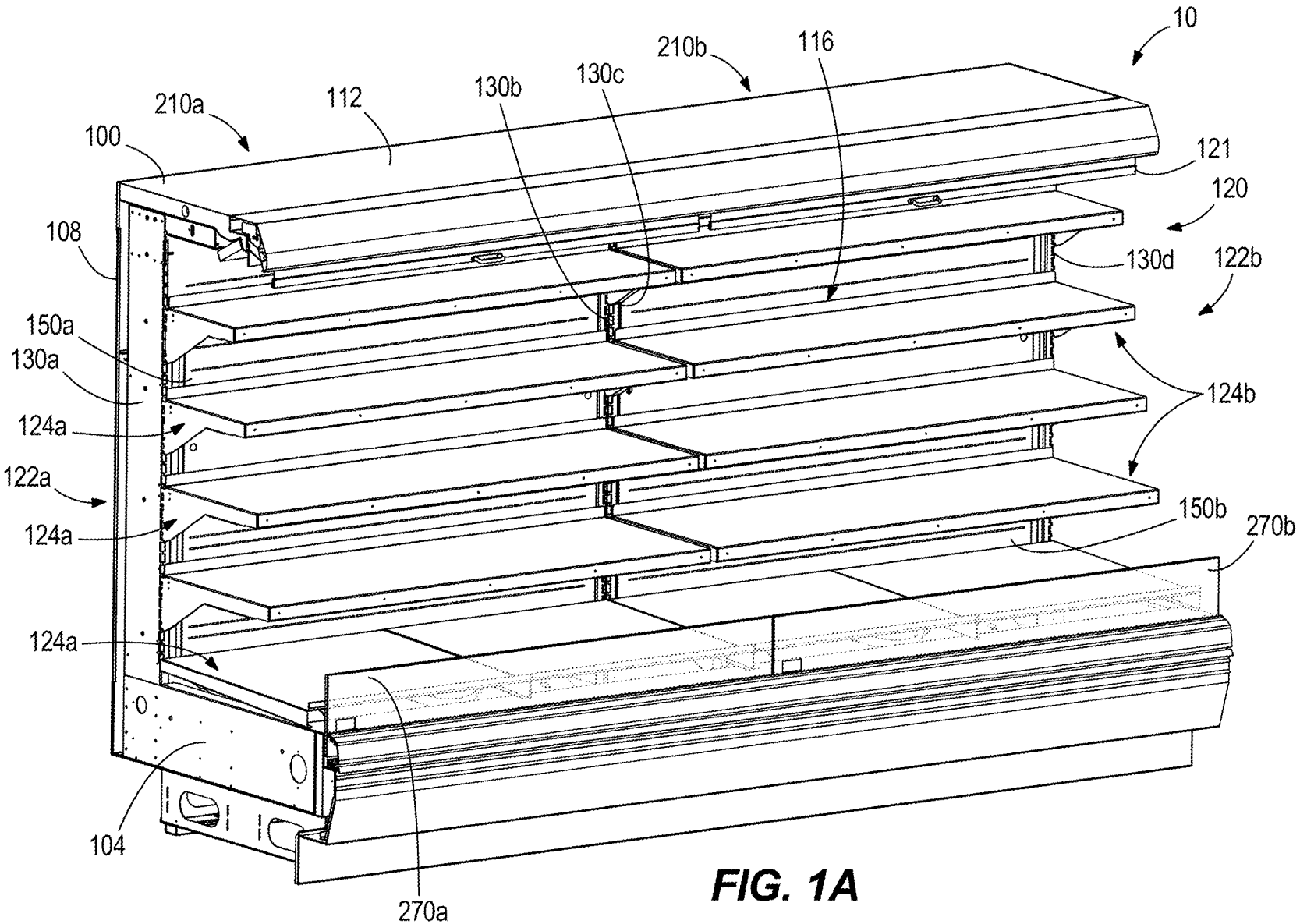
FIG. 1A is a perspective view of a refrigerated merchandiser embodying the invention and including a case with a first configuration that has a base, a rear wall, a first refrigerated section with a first product display arrangement supported by the rear wall, and a second refrigerated section with a second product display arrangement supported by the rear wall.
Figure 1B:
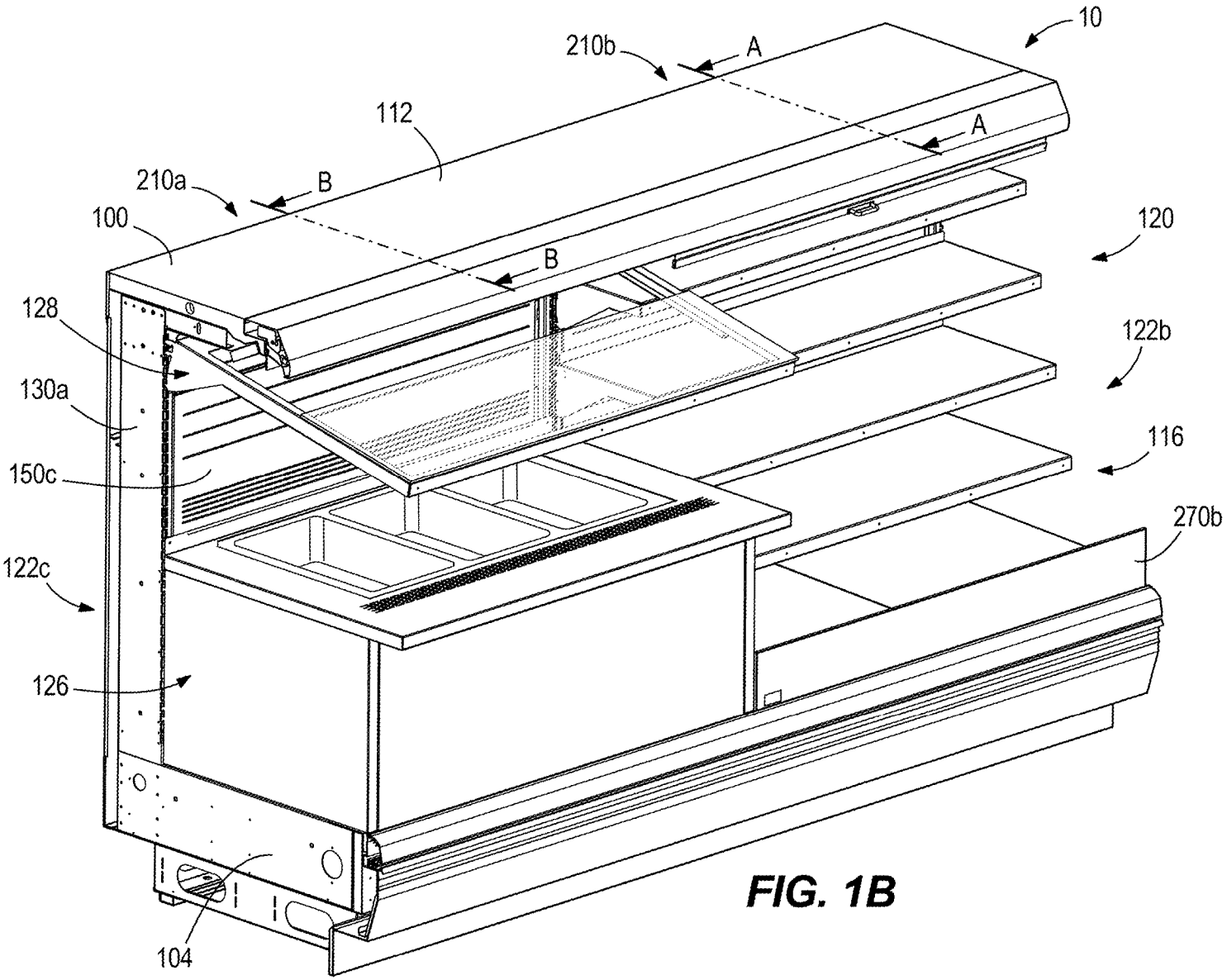
FIG. 1B is a perspective view of the refrigerated merchandiser of FIG. 1A including the case with a second configuration that has the base, the rear wall, the second refrigerated section with the second product display arrangement supported by the rear wall, and the first refrigerated section with a third product display arrangement supported by the rear wall.

FIGS. 1A and 1B show a refrigerated merchandiser 10 including a case 100 that has a base 104, a rear wall 108, and a canopy or case top 112. The area that is partially enclosed by the base 104, the rear wall 108, and the canopy 112 defines a product display area 116. As illustrated, the product display area 116 is accessible by customers through an opening 120 adjacent the front of the case 100. The canopy 112 may have one or more light sources (not shown) for illuminating the product display area 116.

As illustrated, the base 104, the rear wall 108, and the canopy 112 collectively define a case structure of the refrigerated merchandiser 10, and the case structure defines the product display area 116. The case structure and configurations illustrated in various constructions of the Figures are merely exemplary. In other or additional constructions, the case structure may have other configurations. For example, the canopy may be omitted or have other orientations than that shown in the Figures. In another example, the case structure may include additional components not shown herein, such as one or more doors, partition devices, or any other suitable structure for defining the product display area 116 and/or delineating the product display area 116 into one or more portions of the product display area 116. Each of the different configurations may include components of other configurations and or components that are different from one or more of the configurations illustrated in the Figures, and one of ordinary skill in the art will appreciate that other constructions of the exemplary case structures and configurations are contemplated and considered herein.

The refrigerated merchandiser of FIGS. 1A, 1B is a convertible refrigerated merchandiser that includes removable, replaceable, and interchangeable product display arrangements 122*a*, 122*b*, 122*c* that may include one or more of a plurality of shelves 124 with a first configuration, a plurality of shelves with a second configuration that is different from the first configuration, a counter assembly 126 (e.g., a salad bar assembly, deli assembly, a hot food station, a soup station assembly, etc.), a guard 128, or any other suitable structure for product display or access by consumers or other personnel. As discussed in greater detail below, components of each product display arrangement 122*a*, 122*b*, 122*c* are coupled to and supported by the case structure and support and display food product that is accessible from the front of the refrigerated merchandiser 10. As illustrated in the Figures, components of each product display arrangement 122*a*, 122*b*, 122*c* are coupled to and supported by the same base 104 and the same rear wall 108, as will be discussed in greater detail below. In other or additional constructions, components of each product display arrangement 122*a*, 122*b*, 122*c* may be coupled to and supported by other or additional components of the case structure or different case structure. In each construction, the components are interchangeable among different case structures.

As shown in FIGS. 1A-2C, the base 104 defines a lower portion of the product display area 116 and can support food product. With specific reference to FIG. 2A, the base 104 defines a ledge 104*a* that extends at least partially around a perimeter thereof. The rear wall 108 of the case 100 is coupled to and extends from the base 104, and the canopy 112 is coupled to and extends from the rear wall 108. In the illustrated construction, the rear wall 108 includes a plurality of vertical support members 130*a*, 130*b*, 130*c*, 130*d* and a plurality of rear panels 150*a*, 150*b*, 150*c*. A first vertical support member 130*a* is positioned on a first side of the case 100 and a second vertical support member 130*b* is spaced apart from first vertical support member 130*a* in a direction towards a center of the case 100. A fourth vertical support member 130*d* is positioned on a second, opposite side of the case 100 and a third vertical support member 130*c* is spaced apart from the fourth vertical support member 130*d* in a direction towards the center of the case 100. Accordingly, the second vertical support member 130*b* is positioned between the first vertical support member 130*a* and the third vertical support member 130*c*, and the third vertical support member 130*c* is positioned between the second vertical support member 130*b* and the fourth vertical support member 130*d*. Additionally, in the illustrated construction, the second vertical support member 130*b* and the third vertical support member 130*c* are positioned adjacent to one another.

Figure 4A:
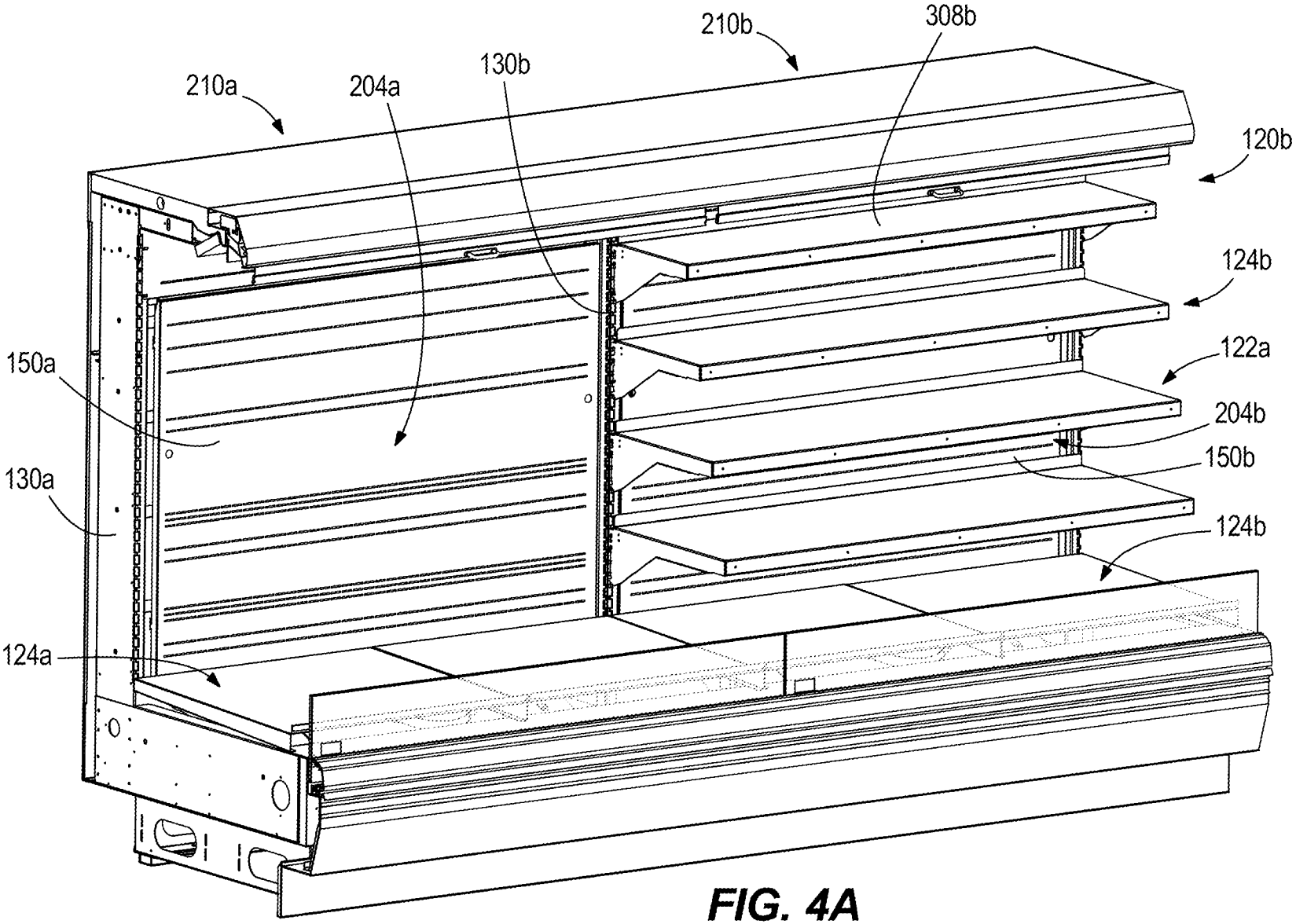
FIG. 4A is a perspective view of the refrigerated merchandiser of FIG. 1A with a portion of the first product display arrangement removed illustrating a rear panel coupled between vertical support members of the rear wall.
Figure 4B:
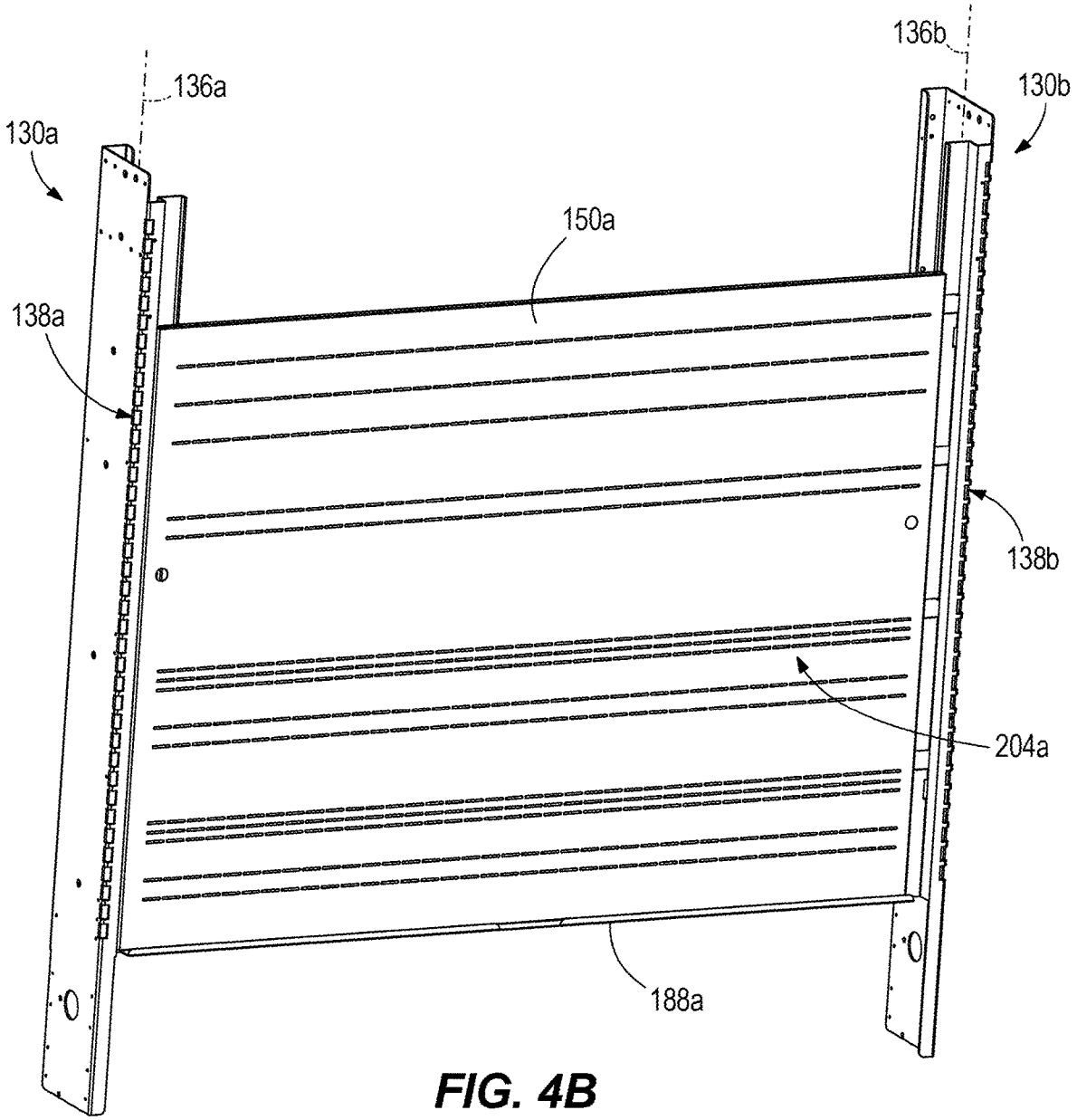
FIG. 4B is an enlarged perspective view of the rear panel coupled to vertical support members of the rear wall of FIG. 4A.
Figure 4C:
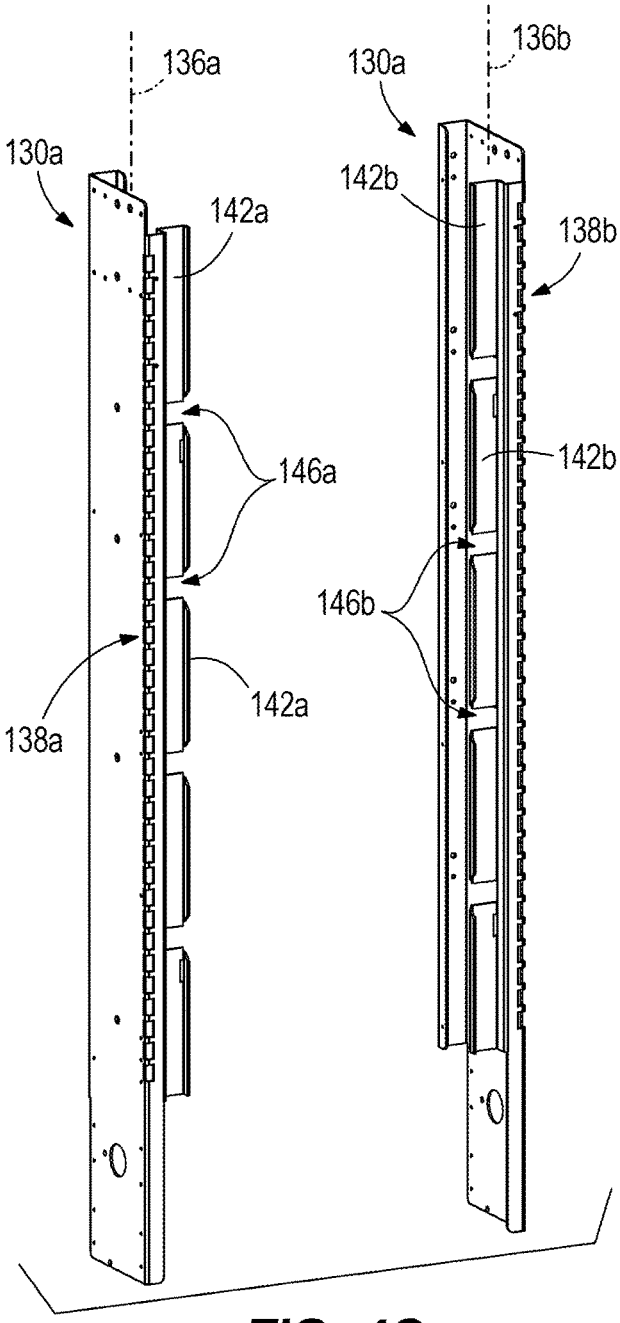
FIG. 4C is an enlarged perspective view of the vertical support members of FIG. 4A.

With reference to FIGS. 4B-4C, each of the vertical support members 130*a*, 130*b*, 130*c*, 130*d* have same structure. Therefore, the following discussion relative to the first vertical support member 130*a* applies to each of the other vertical support members 130*b*, 130*c*, 130*d*. The first vertical support member 130*a* defines a longitudinal axis 136*a*. The first vertical support member 130*a* includes a first plurality of apertures 138*a* that are arranged in a row along the length thereof, a plurality of projections 142*a* (FIG. 4B) extending therefrom and spaced apart along a length thereof, and a second plurality of apertures 144*a* in one or more of the plurality of projections 142*a*. Each pair of adjacent projections 142*a* is separated by a gap 146*a* (FIG. 4B). And the apertures 138*a*, 138*b*, 138*c*, 138*d* of each of the vertical support members 130*a*, 130*b*, 130*c*, 130*d* are aligned with one another.

Figure 2A:
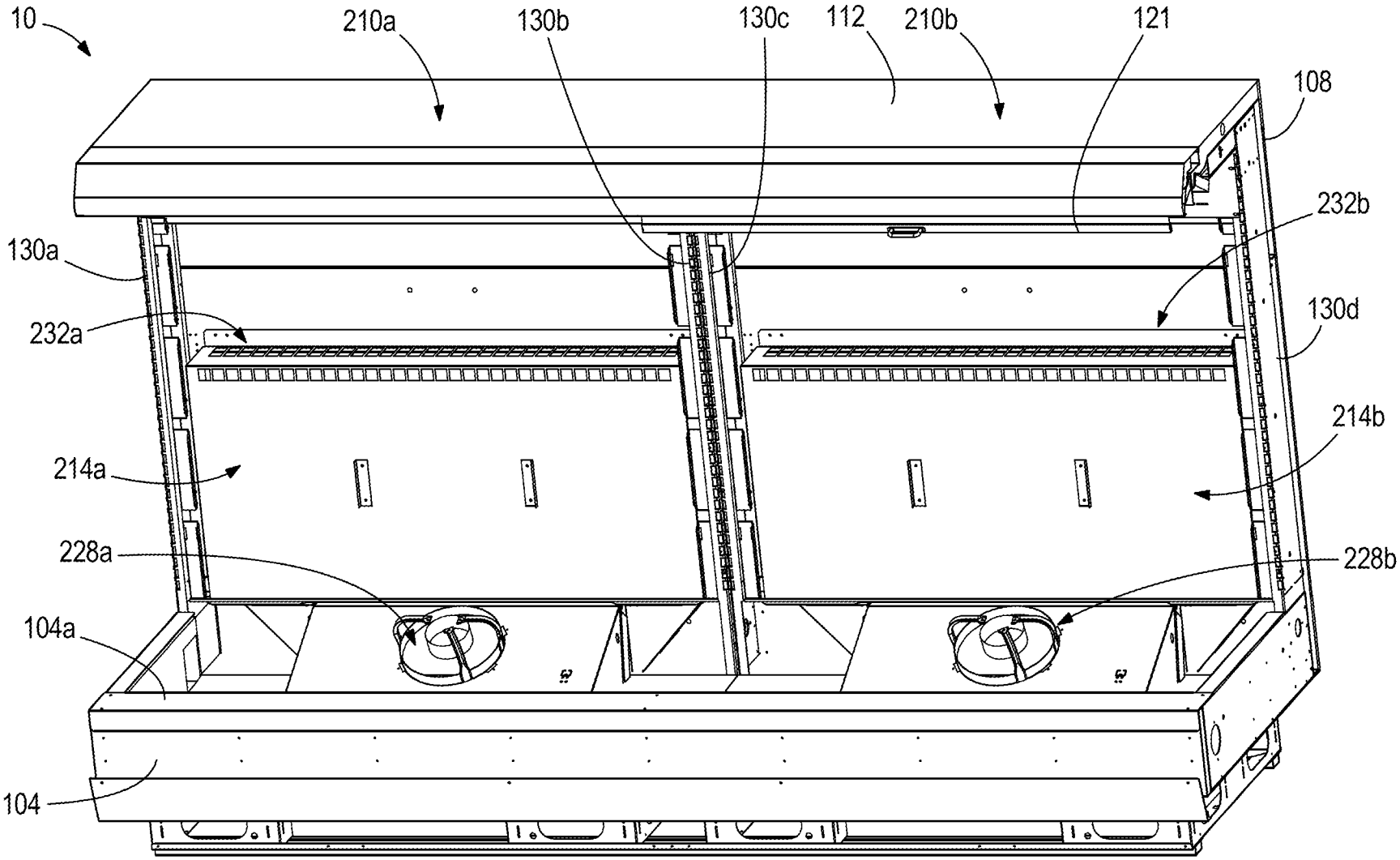
FIG. 2A is a perspective view of the refrigerated merchandiser of FIGS. 1A and 1B with some components removed.
Figure 2B:
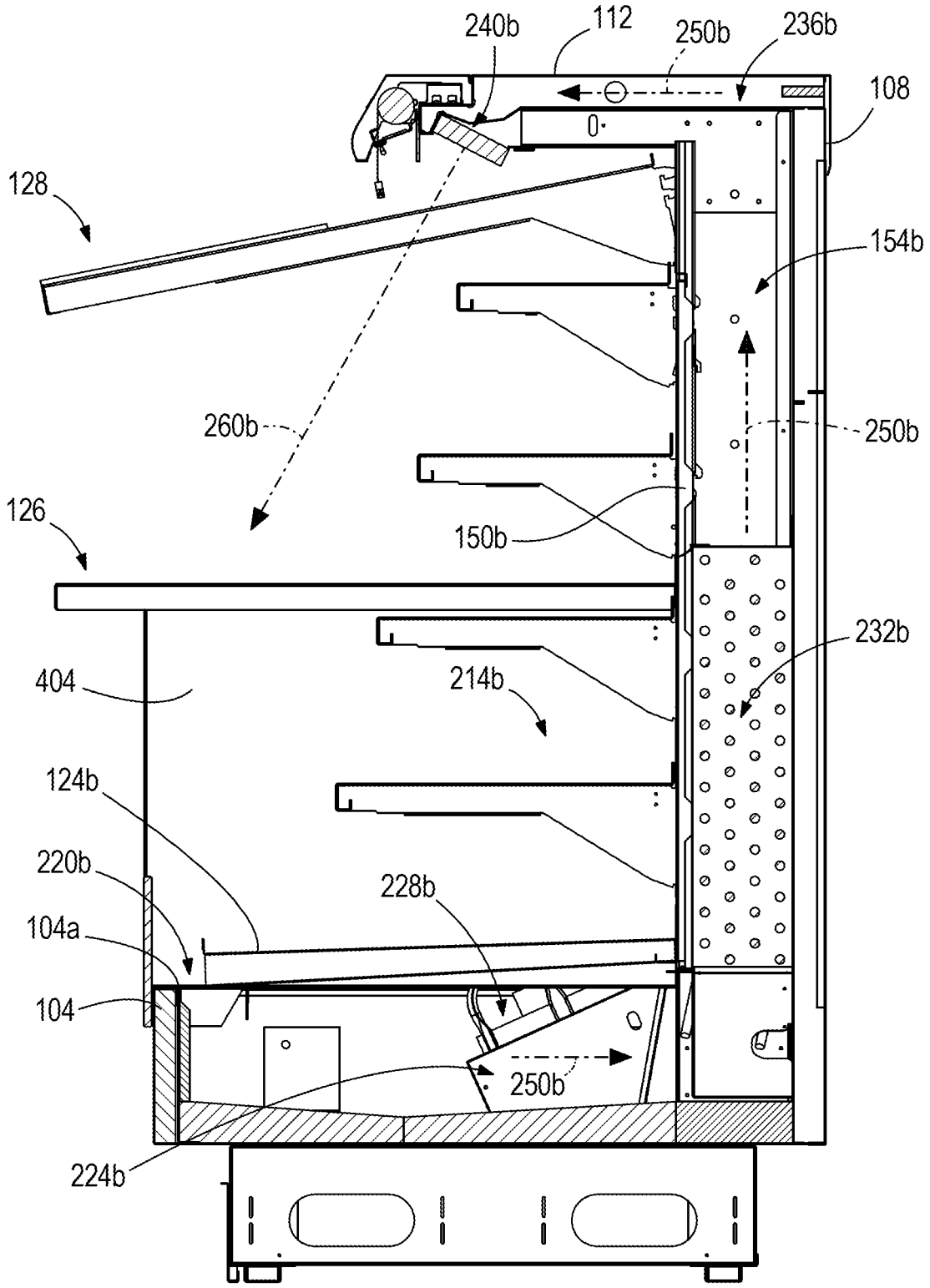
FIG. 2B is a cross-sectional view of the case of FIG. 1B taken along line A-A of FIG. 1B.
Figure 2C:
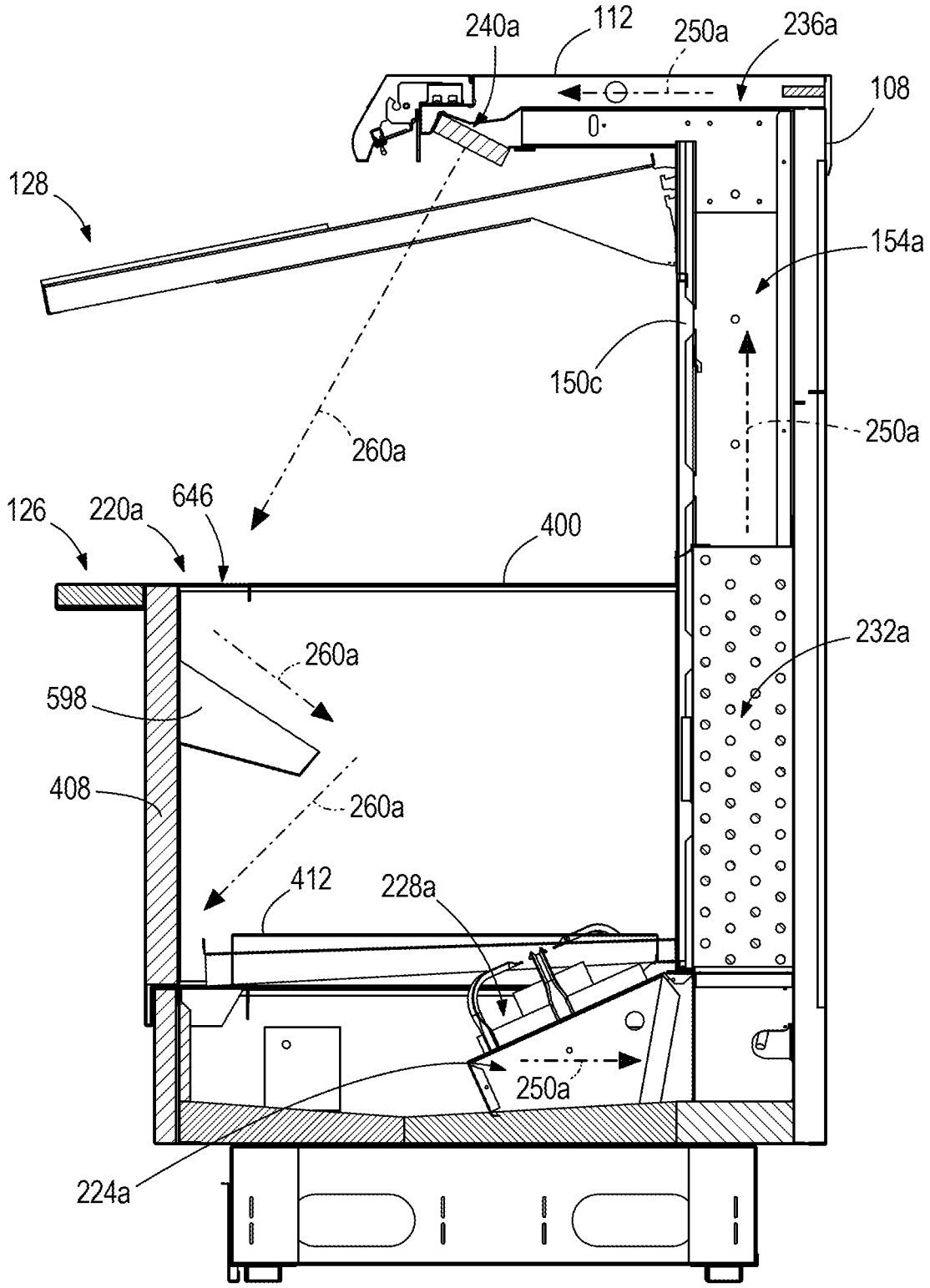
FIG. 2C is a cross-sectional view of the case of FIG. 1B taken along the line B-B of FIG. 1B.
Figure 3:
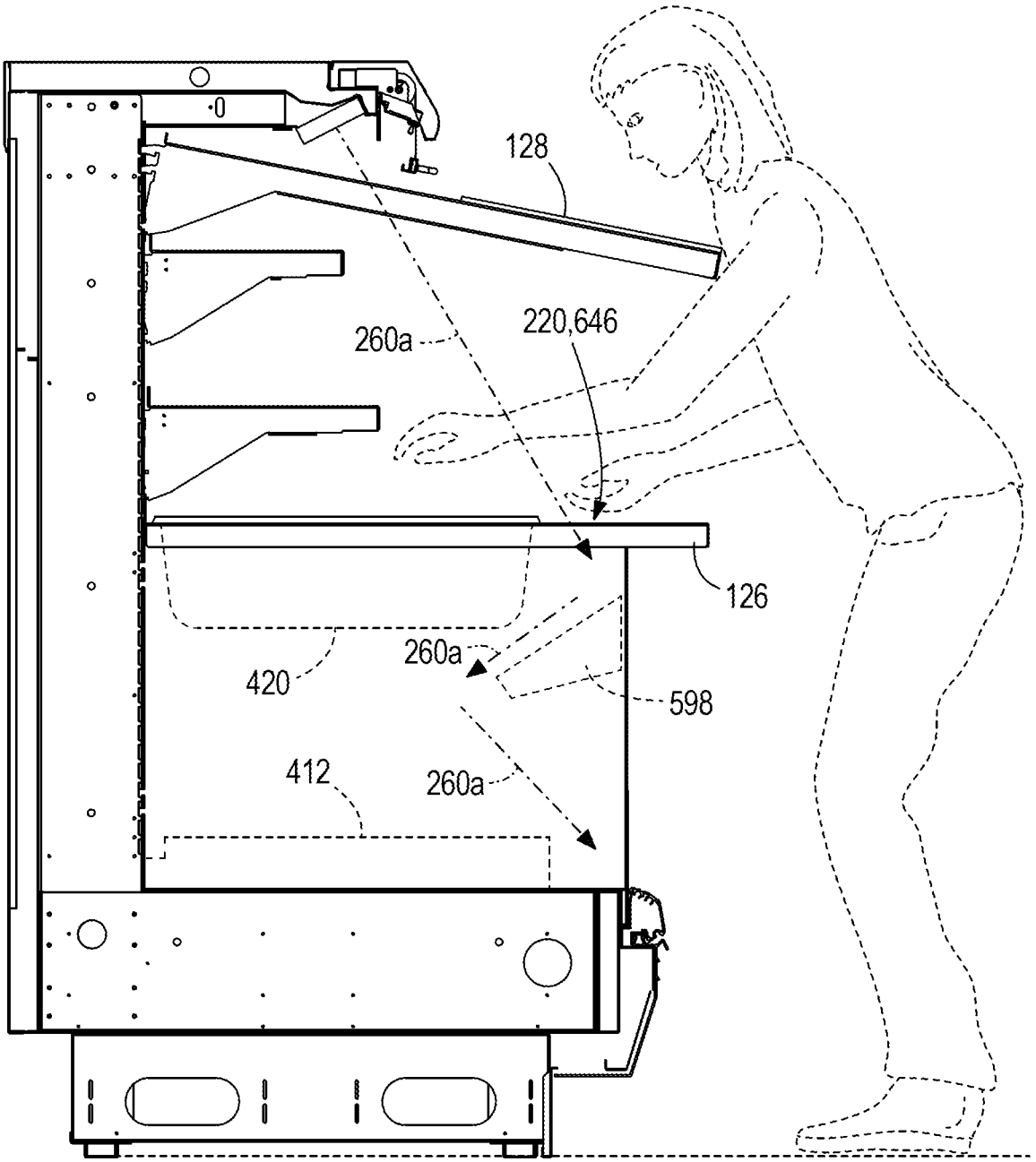
FIG. 3 is a schematic side view of the refrigerated merchandiser in the second configuration of FIG. 1B.

As shown in FIGS. 1A, 1B, 2B, 2C, and 4A, the first rear panel 150*a* is positioned between the first vertical support member 130*a* and the second vertical support member 130*b*. The first rear panel 150*a* is spaced apart from the rear wall 108 by a gap defining a first rear duct 154*a* therebetween. The second rear panel 150*b* is positioned between the third vertical support member 130*c* and the fourth vertical support member 130*d*. The second rear panel 150*b* is spaced apart from the rear wall 108 by a gap defining a second rear duct 154*b* therebetween. Both the first rear panel 150*a* and the second rear panel 150*a* are removable and replaceable with a third rear panel 150*c*, as shown in FIGS. 1B and 2C.

Figure 4D:
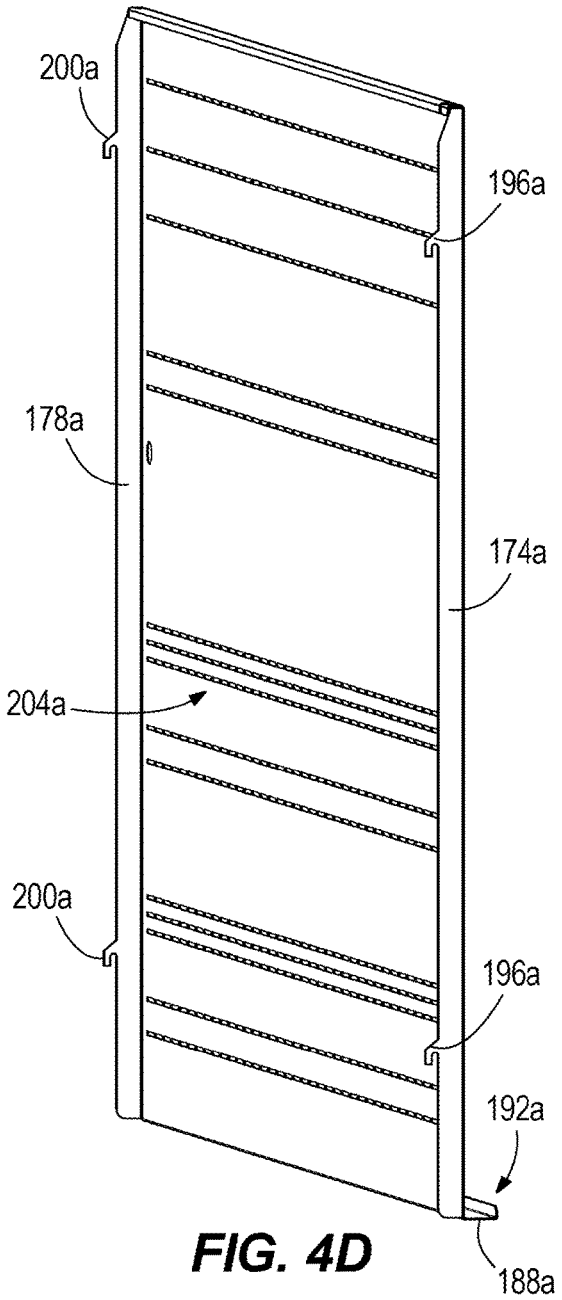
FIG. 4D is an enlarged perspective view of the rear panel of FIG. 4A.
Figure 4E:
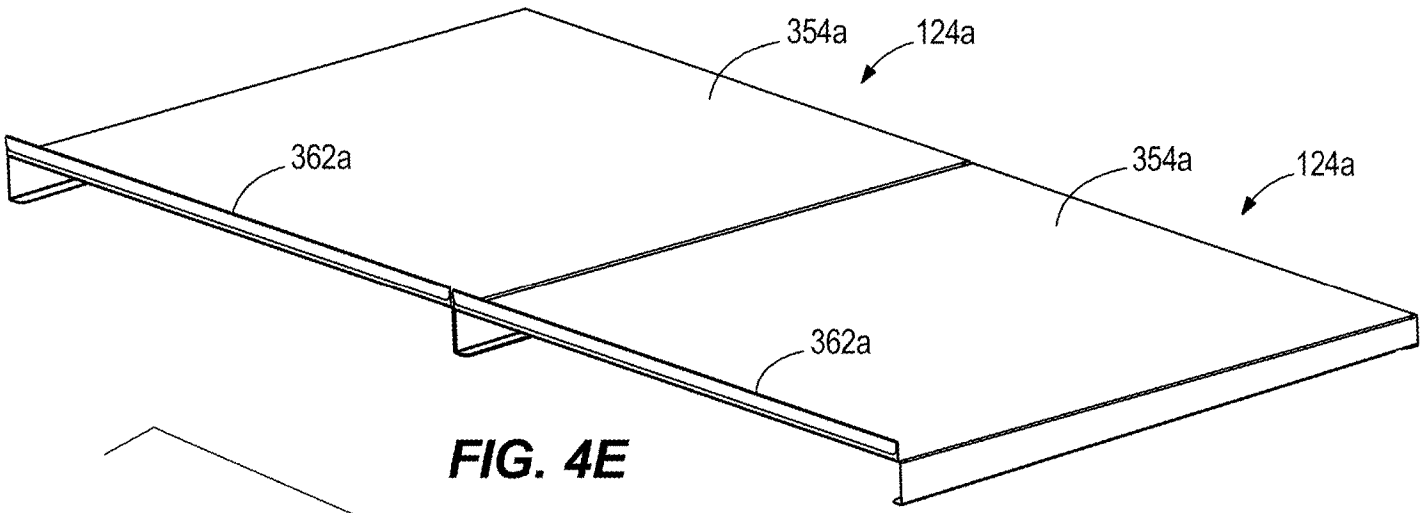
FIG. 4E is a perspective view of lowermost shelves of the first product display arrangement of the refrigerated merchandiser of FIG. 1A.
Figure 4F:
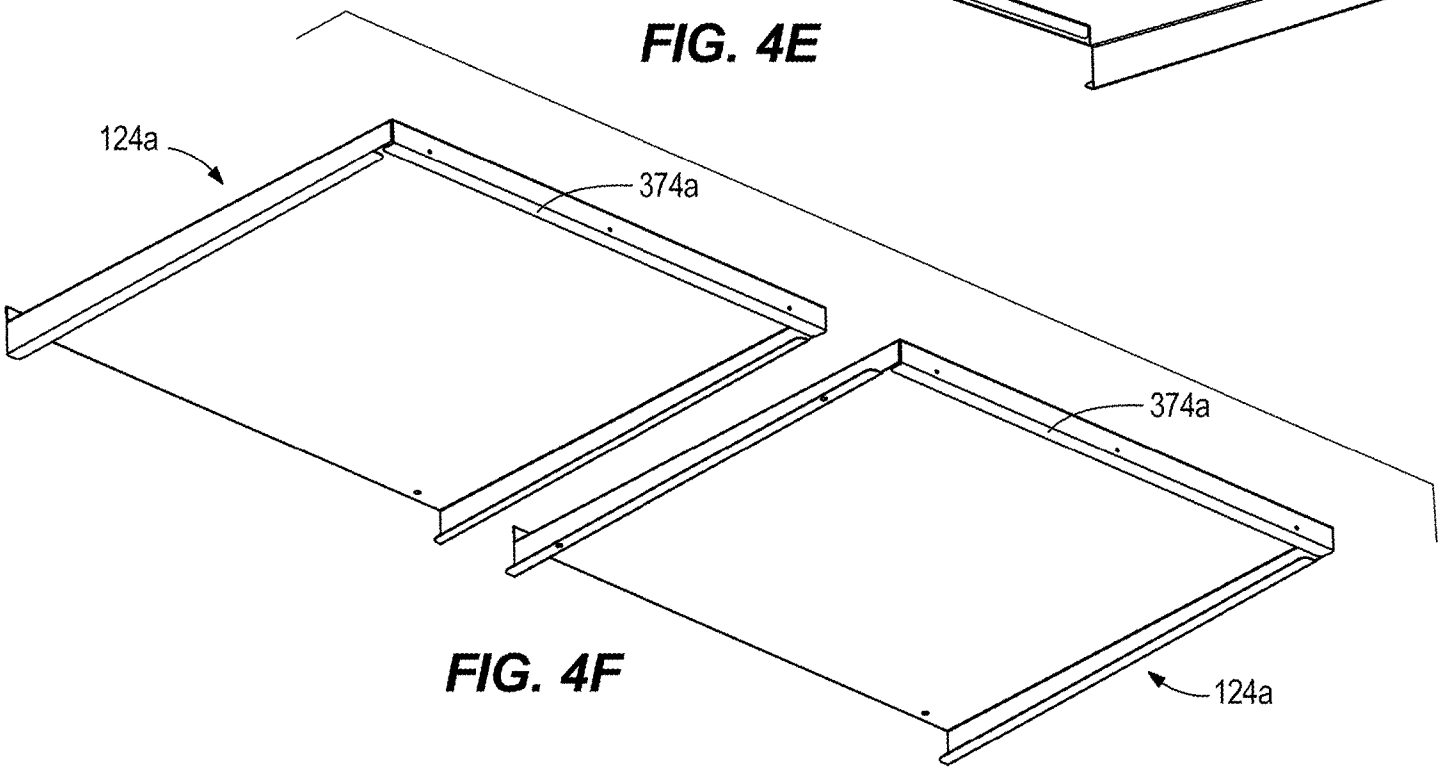
FIG. 4F is an exploded view of the lowermost shelves of FIG. 4E.
Figure 5:
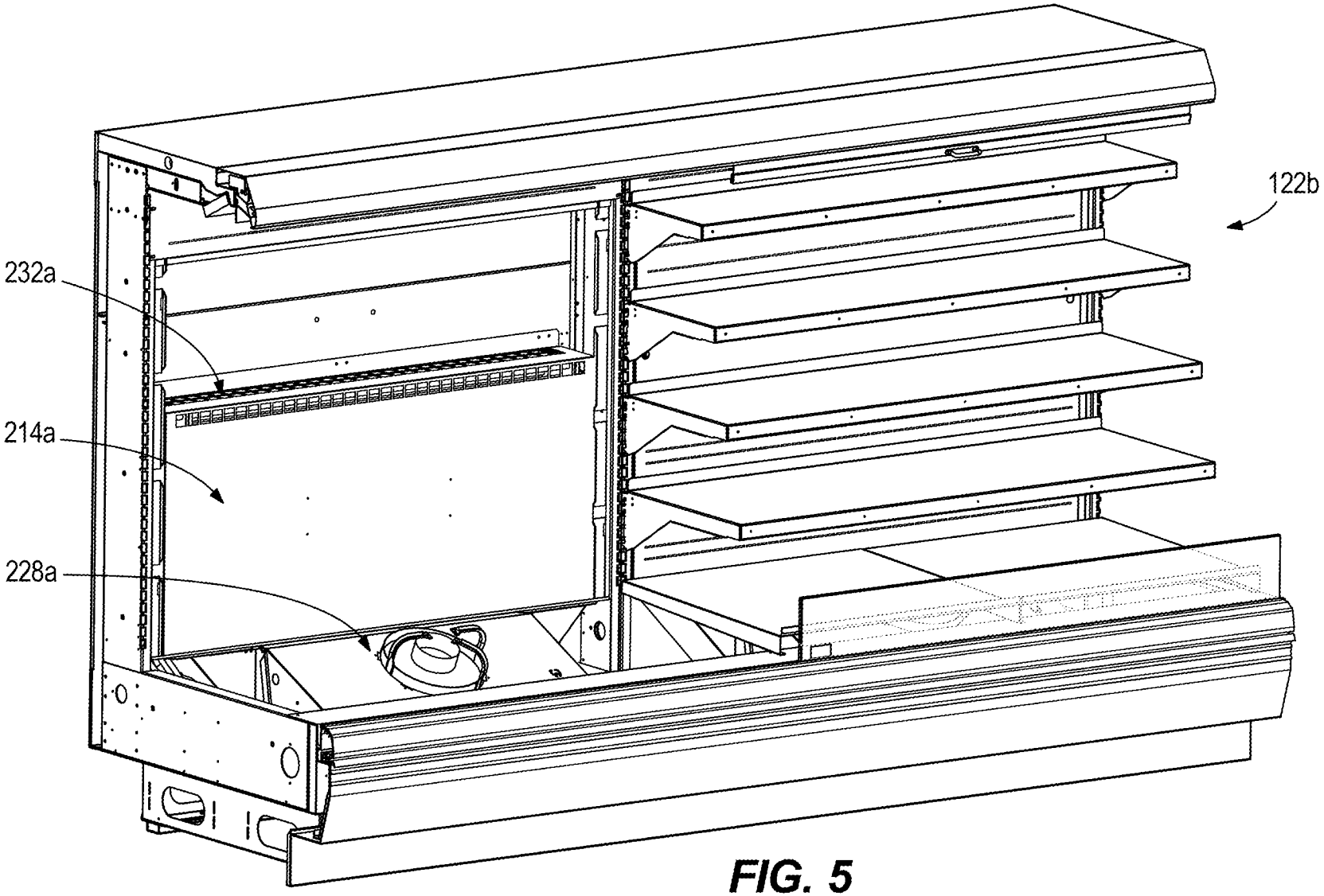
FIG. 5 is a perspective view of the case of FIG. 1A illustrating a first step of the conversion of the first refrigerated section to the third product display arrangement of FIG. 1B including removing the rear panel of FIG. 4A and the first product display arrangement of FIG. 1A.

Each of the rear panels 150*a*, 150*b*, 150*c* has the same structure unless otherwise indicated. Therefore, only the first rear panel 150*a* will be described in detail, and the differences among the different rear panels 150*a*, 150*b*, 150*c* will be highlighted. With reference to FIGS. 4B and 4D, the first rear panel 150*a* includes a first sidewall 174*a* and a second sidewall 178*a* on opposite sides thereof. A flange 188*a* extends from a lower end of the first rear panel 150*a* and defines a generally horizontal channel 192*a* that extends along a width of the first rear panel 150*a*. As will be discussed below, the flange 188*a* and the channel 192*a* are configured to cooperatively secure a portion of the first product display arrangement 122*a*. One or more projections 196*a* extend from each of the first and second sidewalls 174*a*, 178*a*. Each of the projections 196*a*, 200*a* are configured to be received within an aperture 144*a*, 144*b* of the respective vertical support members 130*a*, 130*b* such that the first rear panel 150*a* is removably secured to the rear wall 108 by engagement between the projections 142*a*, 142*b*, 144*a*, 144*b*, 196*a*, 200*a* of the first rear panel 150*a* and the respective vertical support member 130*a*, 130*b*. The first rear panel 150*a* further includes a plurality of apertures 204*a* extending therethrough.

The plurality of apertures 204*a* of the first rear panel 150*a* is arranged in a first configuration or pattern, the plurality of apertures 204*b* of the second rear panel 150*b* is arranged in a second configuration or pattern, and the plurality of apertures 204*c* of the third rear panel 150*c* is arranged in a third configuration or pattern. In the illustrated construction, the first configuration of apertures 204*a* of the respective first rear panel 150*a* and the second configuration of apertures 204*b* of the second rear panel 150*b* are the same, which will be discussed in greater detail below. In some constructions, the first and second configuration of apertures 204*a*, 204*b* may be different from one another. The third configuration of apertures 204*c* of the third rear panel 150*c* is different than the first and second configurations of the apertures 204*a*, 204*b*, which will be discussed below.

As shown in FIGS. 1A-2C, the case 100 of the refrigerated merchandiser 10 includes a first refrigerated section 210*a* and a second refrigerated section 210*b*. Generally, the first refrigerated section 210*a* is positioned between the first vertical support member 130*a* and the second vertical support member 130*b*, while the second refrigerated section 210*b* is positioned between the third vertical support member 130*c* and the fourth vertical support member 130*d*. The refrigerated merchandiser 10 includes a refrigeration system that is supported by the case structure and that is in communication with the first refrigerated section 210*a* and the second refrigerated section 210*b*. In the illustrated construction, the refrigeration system includes a first refrigeration system 214*a* and a second refrigeration system 214*b*. That is, the first refrigerated section 210*a* includes the first refrigeration system 214*a* and the second refrigerated section 210*b* includes the second refrigeration system 214*b*.

In the illustrated construction, each of the first and second refrigeration systems 214*a*, 214*b* are supported at least in part by the case structure. As shown, each of the first and second refrigeration systems 214*a*, 214*b* are supported in part by the base 104 and the rear wall 108. The first refrigeration system 214*a* is shown in FIG. 2C and the second refrigeration system is shown in FIG. 2B. The first refrigeration system 214*a* includes a first inlet 220*a*, a first lower duct 224*a* that is supported by the base 104, and a first fan assembly 228*a* positioned in the first lower duct 224*a*, as well as the first rear duct 154*a*, a first heat exchanger 232*a* (e.g., a first evaporator) that is positioned in the first rear duct 154*a*, a first upper duct 236*a* supported by the canopy 112, and a first outlet 240*a*. The second refrigeration system 214*b* includes a second inlet 220*b*, a second lower duct 224*b* supported by the base 104, and a second fan assembly 228*b* that is positioned in the second lower duct 224*b*, as well as the second rear duct 154*b*, a second heat exchanger 232*b* (e.g., a second evaporator) that is positioned in the second rear duct 154*b*, a second upper duct 236*b* that is supported by the canopy 112, and a second outlet 240*b*.

In the illustrated construction, the first and second refrigeration systems 214*a*, 214*b* are substantially the same. Although the first refrigeration system 214*a* is discussed in detail below, it should be understood that the description of the first refrigeration system 214*a* applies equally to the second refrigeration system 214*b*. In other constructions, the first and second refrigeration systems 214*a*, 214*b* may be different (e.g., including different components to achieve different temperatures in different parts or portions of the product display area 116. That is, for example, the first and second refrigeration systems 214*a*, 214*b* may have other or additional components and/or one or more components may be omitted. In another example, the arrangement of the components of the first refrigeration system 214*a* may be different from the arrangement of the constitute components of the second refrigeration system 214*b*. In still other constructions, the first and second refrigeration systems 214*a*, 214*b* may share components. For example, the first and second refrigeration systems 214*a*, 214*b* may share an inlet, an outlet, and/or a heat exchanger (e.g., an evaporator).

In the illustrated construction, the first and second inlets 220*a*, 220*b* are located at or adjacent to the opening 120 and are in different horizontal planes. In some constructions, the first and second inlets 220*a*, 220*b* may be a single inlet that extends along all or a portion of the width of the case 100.

As shown in FIGS. 2A and 2C, the base 104 supports the first lower duct 224*a* (e.g., first air plenum) and the first fan assembly 228*a* is supported within the first lower duct 224*a*. The first lower duct 224*a* is in fluid communication with the first inlet 220*a* and the first rear duct 154*a*. As illustrated, the first lower duct 224*a* directs a first airflow 250*a* substantially horizontally through the base 104 from the first inlet 220*a* to the first rear duct 154*a*. The first inlet 220*a* is positioned to receive surrounding air in a substantially vertical direction and directs the air into the first lower duct 224*a*. Although the first refrigeration system 214*a* only has one first fan assembly 228*a* in the illustrated construction, in other constructions, the first refrigeration system 214*a* may include more than one fan assembly 228*a*. Moreover, in still other embodiments, the first and second fan assembly 228*a*, 228*b* may be replaced by a single fan assembly.

FIG. 2C shows that the first rear duct 154*a* is in fluid communication with the first lower duct 224*a* and extends upward from the base 104. The fan assembly 228*a* is configured to generate a refrigerated airflow through the first heat exchanger 232*a*. As illustrated, the first heat exchanger 232*a* is positioned in a lower portion of the first rear duct 154*a*. One of ordinary skill in the art will understand and appreciate that the first heat exchanger 232*a* may be located elsewhere in the duct system. Also, in other constructions, one or more fan assemblies 228*a*, 228*b* are configured to generate a refrigerated airflow through the first heat exchanger 232*a* and the second exchanger 232*b*. As oriented, the first airflow 250*a* passes substantially vertically through the first heat exchanger 232*a* and the first rear duct 154*a* directs the first airflow 250*a* generally vertically through the case 100. In the illustrated construction, the plurality of apertures 204*a* in the first rear panel 150*a* (or the apertures 204*c* in the third rear panel 150*c*) can fluidly couple the first rear duct 154*a* with the product display area 116 to permit at least some of the first airflow 250*a* to enter the product display area 116.

The canopy 112 defines the first upper duct 236*a*, which is in fluid communication with the first rear duct 154*a* and directs the first airflow 250*a* substantially horizontally through the canopy 112 toward a first outlet 240*a*. The first lower duct 224*a*, the first rear duct 154*a*, and the first upper duct 236*a* are fluidly coupled to each other to define a first air passageway that directs the first airflow 250*a* from the first inlet 220*a* to the first outlet 240*a*.

The portion of the first airflow 250*a* that is discharged from the first outlet 240*a* forms a first air curtain 260*a* that is directed generally downward across the opening 120 to maintain the food product within a predetermined temperature range (e.g., less than 32 degrees Fahrenheit, between 32 to 41 degrees Fahrenheit, between 41 to 75 degrees Fahrenheit, or at or above 150 degrees Fahrenheit). In the illustrated construction, the first and second refrigerated sections 210*a*, 210*b* maintain the food product within the same predetermined temperature range, but in other or additional constructions, the first and second refrigerated sections 210*a*, 210*b* may maintain the food product within different predetermined temperature ranges. Generally, the first inlet 220*a* receives at least some air from the first air curtain 260*a*. The case 100 may have an additional air passageway to direct a secondary air curtain downward across the opening 120. The first air curtain 260*a* and/or the second air curtain (when included) may be oriented at a suitable angle relative to a vertical plane that is oriented perpendicular to a support surface (e.g., the ground or floor) on which the merchandiser is supported. For example, the first air curtain 260*a* and/or the second air curtain (when included) may be oriented at an angle that is less than 10 degrees (e.g., horizontal merchandisers) or greater than 10 degrees relative to the vertical plane (e.g., self-service, or upright merchandisers).

As shown in FIG. 1A, the refrigerated merchandiser has a first configuration in which the first refrigerated section 210*a* includes the first product display arrangement 122*a* that is supported by the case structure (e.g., the rear wall 108) and the second refrigerated section 210*b* includes the second product display arrangement 122*b* that is supported by the case structure (e.g., the rear wall 108). The first product display arrangement 122*a* includes a plurality of shelves 124*a* supported by the rear wall 108 and the second product display arrangement 122*b* includes a plurality of shelves 124*b* supported by the rear wall 108. In the illustrated construction, each of the first and second product display arrangements 122*a*, 122*b* also include respective first and second vertical members 270*a*, 270*b* supported by a recess 274 (FIG. 13) in the base 104 adjacent the opening 120 and the lowermost shelves 124*a*, 124*b*. In the illustrated construction the recess 274 is an elongate recess that extends along the width of the case 100. In other constructions, the recess 274 may be separated into two recesses—one for each of the first and second refrigerated sections 210*a*, 210*b*.

As shown, the plurality of shelves 124*a*, 124*b* includes some that are suspended above the base 104 (e.g., suspended shelves) and some that are supported by the base 104 (e.g., lowermost shelves). With respect to FIG. 4A, the description of the shelves 124*b* of second product display arrangement

Figure 6:
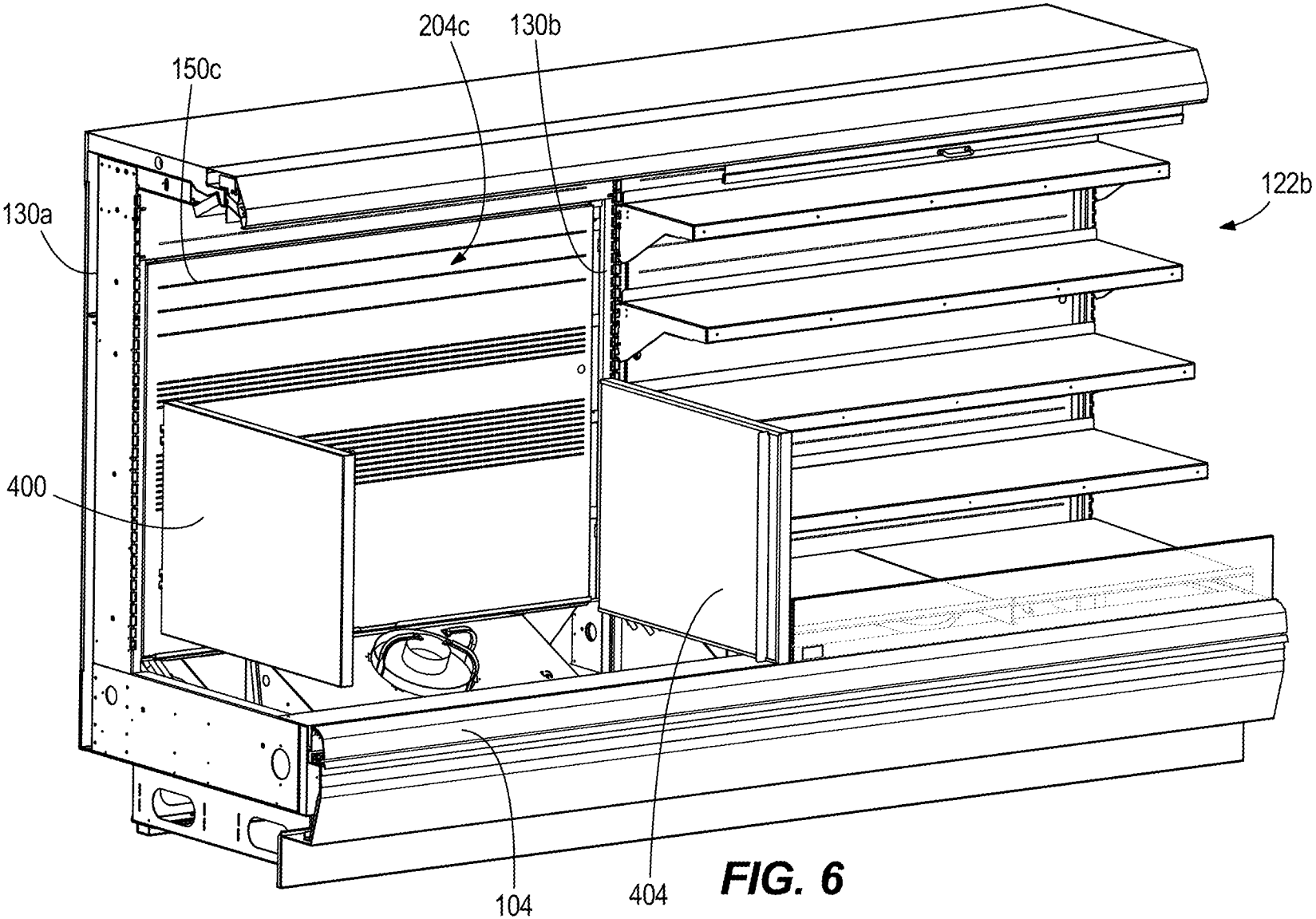
FIG. 6 is a perspective view of the case of FIG. 1A illustrating a second step of the conversion of the first refrigerated section to the third product display arrangement of FIG. 1B including coupling another rear panel and side panels to the rear wall.
Figure 7:
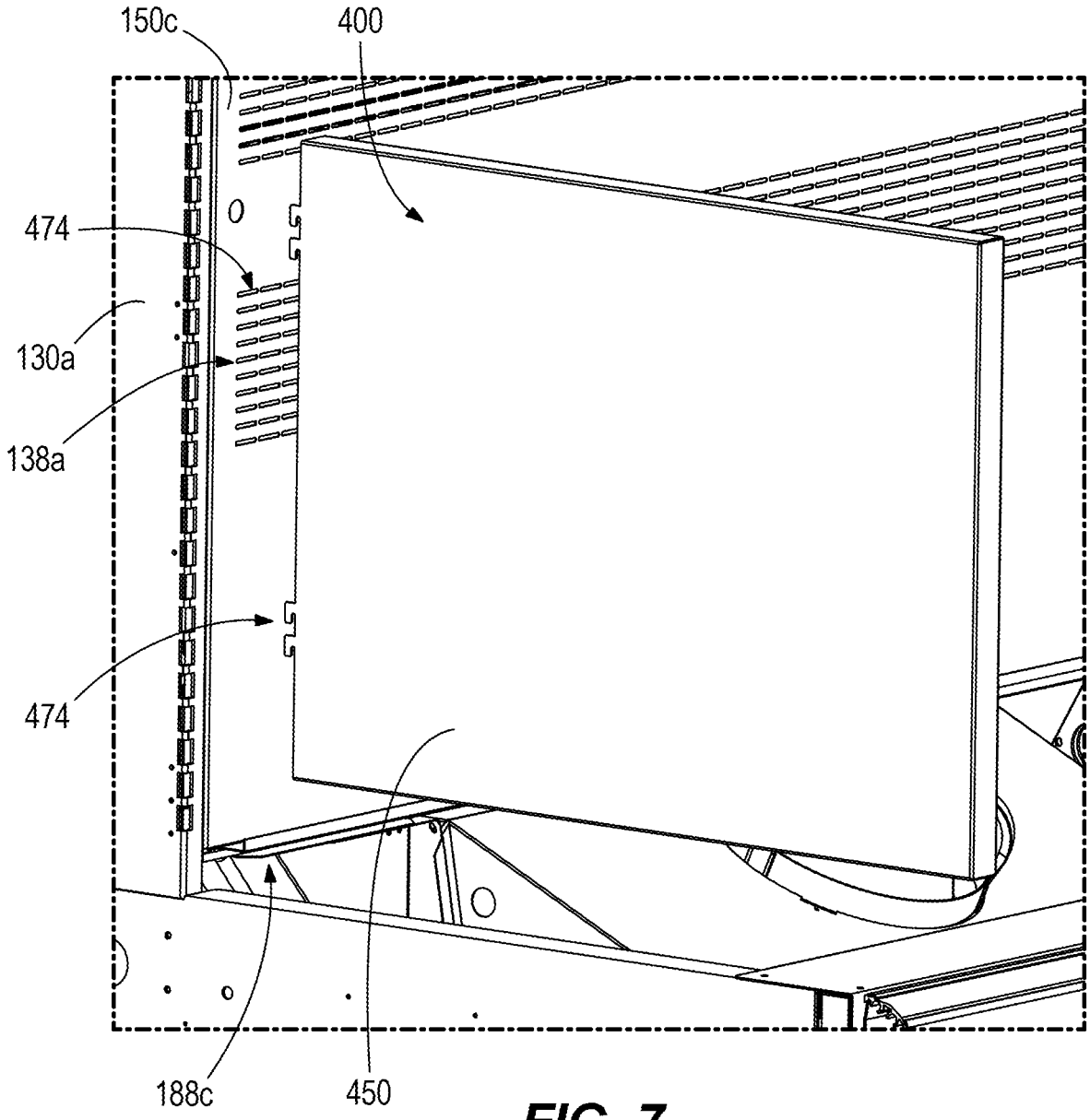
FIG. 7 is an enlarged perspective view of FIG. 6 illustrating one side panel of the third product display arrangement.
Figure 8:
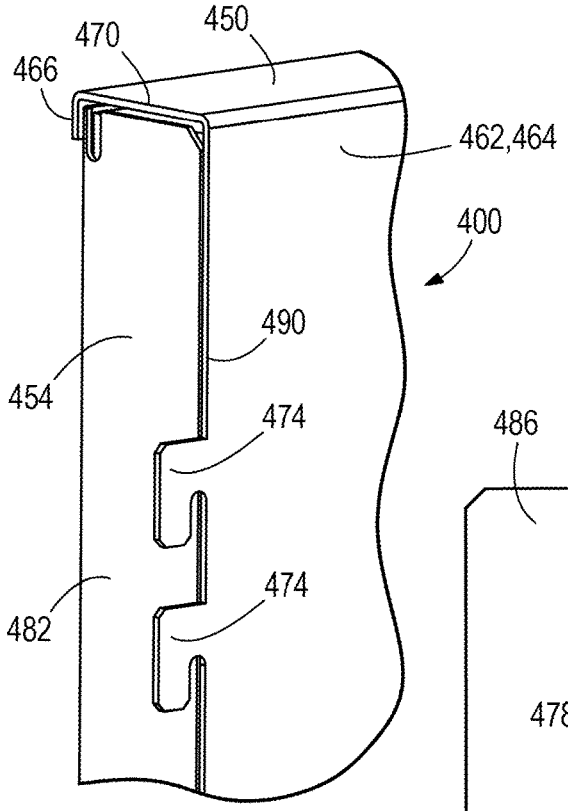
FIG. 8 is an enlarged perspective view of a portion of the side panel of FIG. 7.
Figure 9:
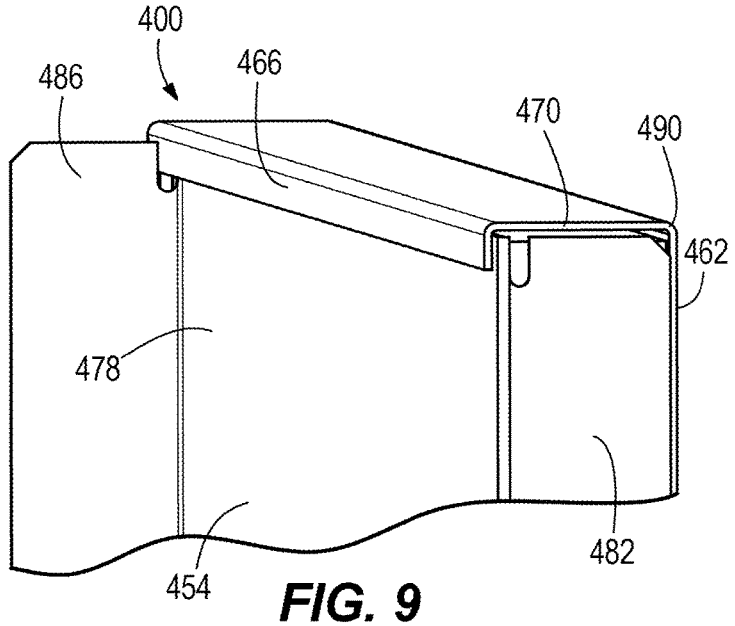
FIG. 9 is another enlarged perspective view of a portion of the side panel of FIG. 7.
Figure 10:
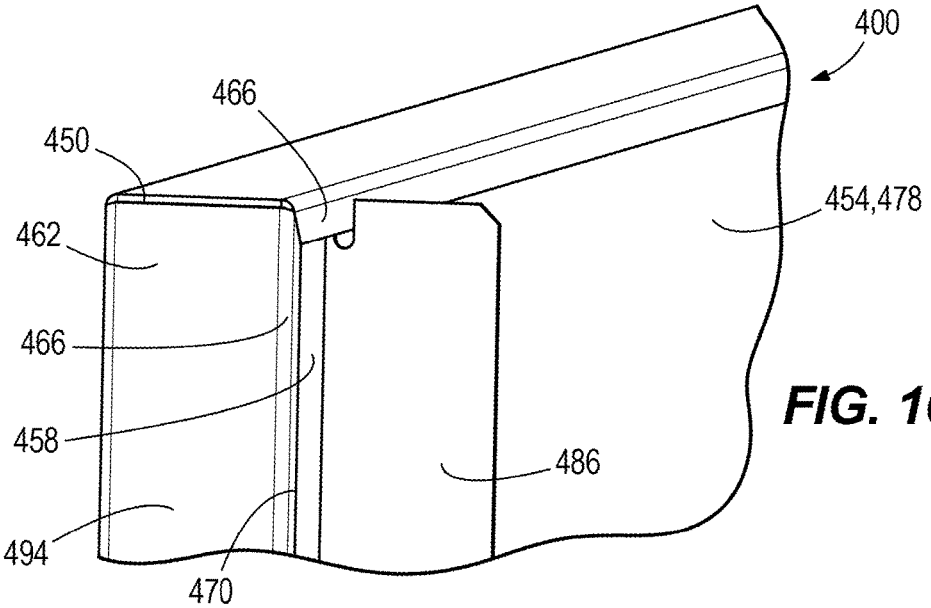
FIG. 10 is another enlarged perspective view of a portion of the side panel of FIG. 7.

122*b* applies to the shelves 124*a* of the first product display arrangement 122*a*. Each of the shelves 124*b* defines a substantially horizontal support surface 308*b* for supporting product. Each of the shelves 124*b* includes one or more L-shaped hooks or projections (not shown) on opposite sides of the horizontal support surface 308*b*. Although not shown in the context of the shelves 124*b*, similar hooks are shown relative to the third product display arrangement 122*c* in FIGS. 6-8, for example, and are discussed in greater detail below. Each of the hooks of the shelves 124*b* is cooperatively received in one or more corresponding apertures 138*c*, 138*d* in respective vertical support member 130*c*, 130*d* such that the vertical support members 130*c*, 130*d* support the shelves 124*b* relative to the rear wall 108 and product display area 116.

In the illustrated construction, the plurality of shelves 124*a* of the first display arrangement have a first configuration and the plurality of shelves 124*b* of the second display arrangement have a second configuration that is the same as the first configuration. Accordingly, the suspended shelves 124*a* of the first product display arrangement 122*a* are arranged in a first column and the suspended shelves 124*b* of the second product display arrangement 122*b* are arranged in a second column. In the illustrated construction, each of suspended shelves 124*a* of the first product display arrangement 122*a* is aligned with a corresponding suspended shelf 124*b* of the second product display arrangement 122*b* such that the respective horizontal support surfaces 308*a*, 308*b* are positioned in the same plane. Generally, then, the pairs of aligned suspended shelves 124*a*, 124*b* each define a row that extends across the width of the case 100. In other or additional constructions, the first configuration of the plurality of shelves 124*a* of the first display arrangement may be different than second configuration the plurality of shelves 124*b* of the second display arrangement. For example, each of suspended shelves 124*a* of the first product display arrangement 122*a* may be staggered with a corresponding suspended shelf 124*b* of the second product display arrangement 122*b* such that the respective horizontal support surfaces 308*a*, 308*b* are positioned in the different planes. In another example, each of suspended shelves 124*a* of the first product display arrangement 122*a* may positioned at a first angle relative to the rear wall, whereas each of the suspended shelves 124*b* of the second product display arrangement 122*b* may be positioned a second, different angle relative to the rear wall 108. In still another example, there may be more suspended shelves 124*a* than suspended shelves 124*b* or vice versa.

FIGS. 4A, 4E-4G, and 13 show that the lowermost shelves 124*a*, 124*b* are supported by the respective rear panel 150*a*, 150*b* (e.g., the flanges 188*a*, 188*b* thereof) and the base 104. As shown, each of the lowermost shelves 124*a*, 124*b* have the same construction and therefore only those of the first product display arrangement 122*a* will be described in detail. The lowermost shelves 124*a* each include a body 350*a* that has a support wall 354*a*, a lip 362*a*, and a flange 374*a*. The flange 374*a* extends from the body 350*a* and is spaced apart from and below the support wall 354*a*. The flange 374*a* is configured to be received in the channel 192*a* of the flange 188*a* of the first rear panel 150*a* and is configured to abut a wall of the flange 188*a* that defines the channel 192. The lip 362*a* prevents product from spilling off the shelf. The body 350*a* of each of the lowermost shelves 124*a* is configured to be supported by the base 104 and the adjacent lowermost shelf 124*a*, 124*b*. The support wall 354*a* of the lowermost shelves 124*a* are in the same plane and are positioned at a non-perpendicular angle relative to the first rear panel 150*a*. The first vertical member 270*a* is positioned forwardly of the lowermost shelves 124*a* also prevents product on the support walls 354*a* of the lowermost shelves 124*a*, 124*b* from falling off the refrigerated merchandiser 10 due to the incline.

As shown in FIGS. 4A, 4B, and 4D, the first configuration of the apertures 204*a* in the first rear panel 150*a* and the second configuration of the apertures 204*b* in the second rear panel 150*b* are configured to guide at least some of the first and second airflows 250*a*, 250*b* towards the product supported by the shelves 124*a*, 124*b*. As shown, each of the first and second configurations has a plurality of rows of apertures 204*a*, 204*b* extending across a width of the respective first and second rear panel 150*a*, 150*b* such that one or more of the rows is positioned above and/or below each shelf 124*a*, 124*b*. In the illustrated construction, there are fewer rows positioned in a top portion of the first and second rear panels 150*a*, 150*b* than there are rows positioned in a bottom portion of the first and second rear panels 150*a*, 150*b* (e.g., there are half as many rows in the top portion of the first and second rear panels 150*a*, 150*b* than in the bottom portion of the rear panels 150*a*, 150*b*). Because the illustrated first and second rear panels 150*a*, 150*b* have the same aperture configuration, the first and second airflows 250*a*, 250*b* are guided along generally similar or the same airflow paths. That is, the first airflow is guided along a first airflow path and the second airflow 250*b* is guided along a second airflow path that is similar to or the same as the first airflow path. The apertures 204*a*, 204*b* may have other configurations depending on several factors, including the configuration (e.g., quantity and/or location) of the shelves 124*a*, 124*b*. In constructions in which the aperture configurations in the rear panels 150*a*, 150*b* are different, the first and second airflows 250*a*, 250*b* may be guided along different airflow paths.

Comparing FIGS. 1A and 1B, the refrigerated merchandiser 10 can be converted from the first configuration of FIG. 1A to a second configuration of FIG. 1B. When in the second configuration, the first refrigerated section 210*a* includes the third product display arrangement 122*c* that is supported by the case structure (e.g., the rear wall 108) and the second refrigerated section 210*b* includes the second product display arrangement 122*b* that is supported by the case structure (e.g., the rear wall 108). That is, and as described in greater detail below, the first product display arrangement 122*a* is removable from the first refrigerated section 210*a* and replaceable with a third product display arrangement 122*c*. In some constructions, the second product display arrangement 122*b* is removable from the second refrigerated section 210*b* and replaceable with the third product display arrangement 122*c*. In other constructions contemplated herein, the first product display arrangement 122*a* and the second product display arrangement 122*b* may be each removable from the respective first and second refrigerated sections 210*a*, 210*b* and replaceable with the third product display arrangement 122*c* and a fourth product display arrangement (not shown). While an exemplary construction is described in detail with regard to changing the first product display arrangement 12*a* to the third product display arrangement 122*c*, it should be understood and appreciated that any part of the product display arrangement of the merchandiser 10 may be changed or adjusted to modify the merchandising capability of the merchandiser 10.

With reference to FIGS. 1B and 6-27B, in the illustrated construction, the third product display arrangement 122*c* includes a counter assembly 126. In the illustrated construction, the counter assembly 126 has a first side panel 400, a second side panel 404, a front panel 408, one or more lower panels 412, a countertop assembly 416, and a plurality of food pans 420 supported by the countertop assembly 416. It should be noted that the counter assembly 126 illustrated and discussed herein is merely exemplary and, in other constructions, may have any other suitable components and configurations. It should be noted that while in the illustrated construction the third product display arrangement 122*c* is a counter assembly 126, in other constructions, the third product display arrangement 122*c* may have another product display arrangement, such as a plurality of shelves having a configuration that is different than the first configuration shown in FIG. 1A or any other suitable product display arrangement. Moreover, in the instance in which a fourth product display arrangement is also used, it may be supported by case structure (e.g., the rear wall 108) and have any suitable components and configuration.

With reference to FIGS. 6-11, the first side panel 400 and the second side panel 404 are insulated panels and are supported by the rear wall 108 and the base 104. In particular, the first side panel 400 is supported by the first vertical support member 130*a* and the base 104, and the second side panel 404 is supported by the second vertical support member 130*b* and the base 104. The first and second side panels 400, 404 have the same construction, and although only the first side panel 400 is discussed in detail, the discussion thereof applies equally to the second side panel 404. The first side panel 400 is formed of three pieces in the illustrated construction. The first side panel 400 includes a first portion 450 (e.g., an outer portion), a second portion 454 (e.g., an inner portion) that is coupled to the first portion 450, and a third portion 458 (e.g., an insulative portion) that is positioned between the first portion 450 and the second portion 454. In the illustrated construction, the third portion 458 is formed from foam and therefore defines a foam slab. In other constructions, the third portion 458 may be formed from other insulative materials in lieu of or in addition to foam. In other constructions, the third portion 458 may be omitted such that the first and second panels 400, 404 may be uninsulated panels.

The first portion 450 includes a rectangular body 462 with a first or outer wall 464 and one or more side walls 465 that extend from the outer wall 464. In the illustrated construction, there are three side walls 465, but in other constructions the body 462 may have other configurations. Each of the sides walls 465 have a flange 466 extending therefrom. Collectively, the outer wall 464, the side walls 465, and the flanges 466 define a recess 470, which receives the third portion 458. One or more L-shaped hooks or projections 474 extend from a rear edge 490 of the body 462 of the first portion 450. The hooks 474 are configured to be received in respective apertures 138*a* of the first vertical support member 130*a*. The second portion 454 includes a second or inner wall 478, a first flange 482 extending in a first direction from the inner wall 478 and a second flange 486 extending in a second direction from the inner wall 478. The second portion 454 is positioned relative to the first portion 450 such that the inner wall 478 abuts a portion of each of the flanges 466 of the first portion 450 and the first flange 482 of the second portion 454 abuts the rear edge 490 of the first portion 450. The inner wall 478 and the first flange 482 of the second portion 454 enclose at least a portion of the recess 470. As shown, the first portion 450 and the second portion 454 cooperatively define a pocket therebetween. In the illustrated construction, the pocket receives the third portion 458, but in other constructions, the pocket may remain empty. Accordingly, the third portion 458 is sandwiched between the first portion 450 and the second portion 454. Moreover, the third portion 458 is sandwiched between the outer wall 464 and the inner wall 478. The second flange 486 is positioned adjacent a front edge 494 (e.g., a front side wall 465, FIG. 10) of the first portion 450 and extends therefrom. The first and second side panels 400, 404 are supported by the ledge 104*a* of the base 104.

The first and second panels 400, 404 are merely exemplary and may have other configurations than that discussed herein. For example, the first and second panels 400, 404 may be integrally formed as a single piece, with or without insulation. That is, in some constructions, the first and second panels 400, 404 may not be insulated and be integrally formed (rather than first and second portions 450, 454 coupled to one another) such that there is no pocket between the outer wall 464 and the inner wall 478. In other constructions, the first and second panels 400, 404 be integrally formed without insulation in the pocket between the outer wall 464 and the inner wall 478.

Figure 11:
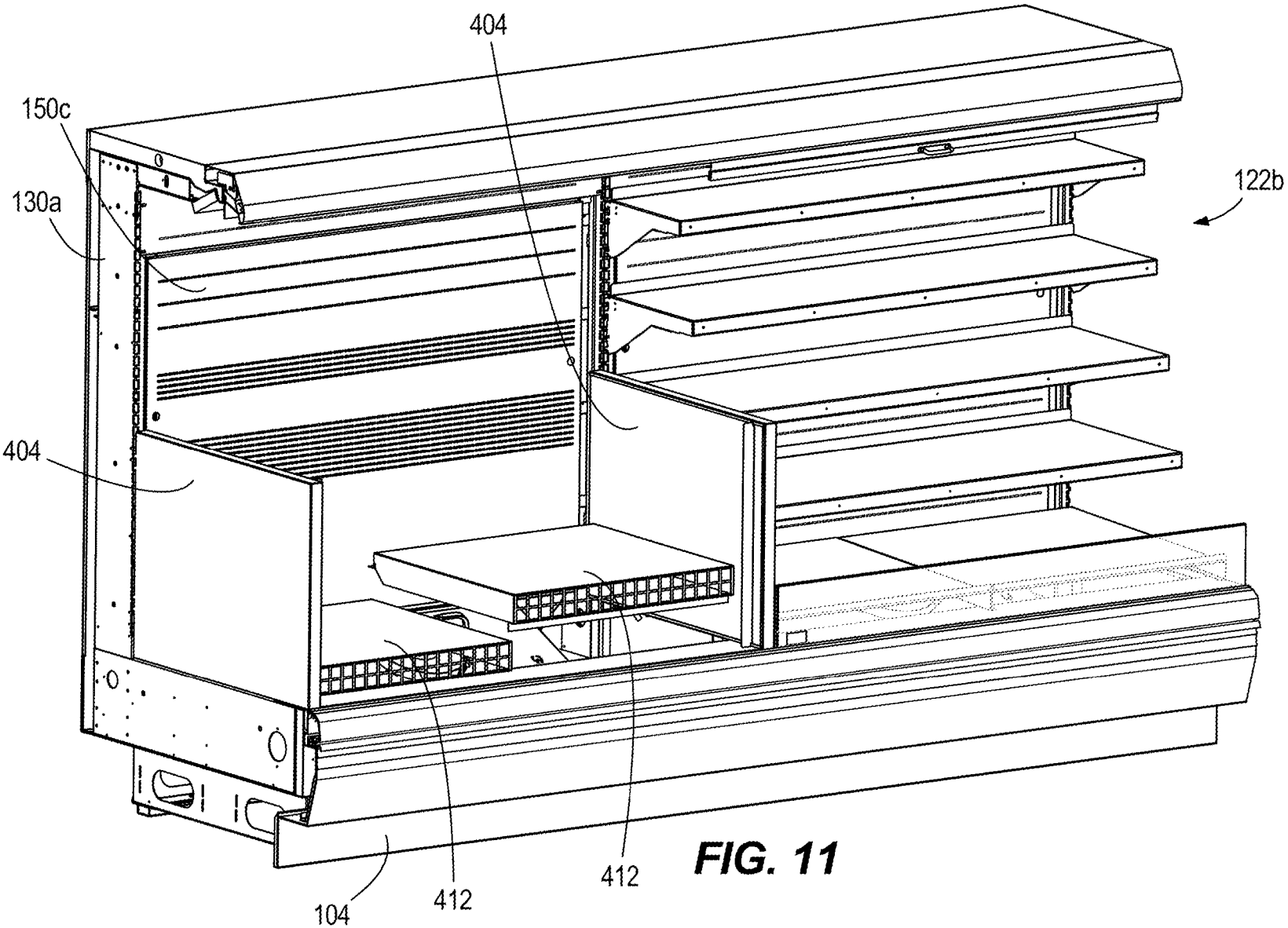
FIG. 11 is a perspective view of the case of FIG. 1A illustrating a third step of the conversion of the first refrigerated section to the third product display arrangement of FIG. 1B including coupling lower panels to the rear panel and the base.
Figure 12:
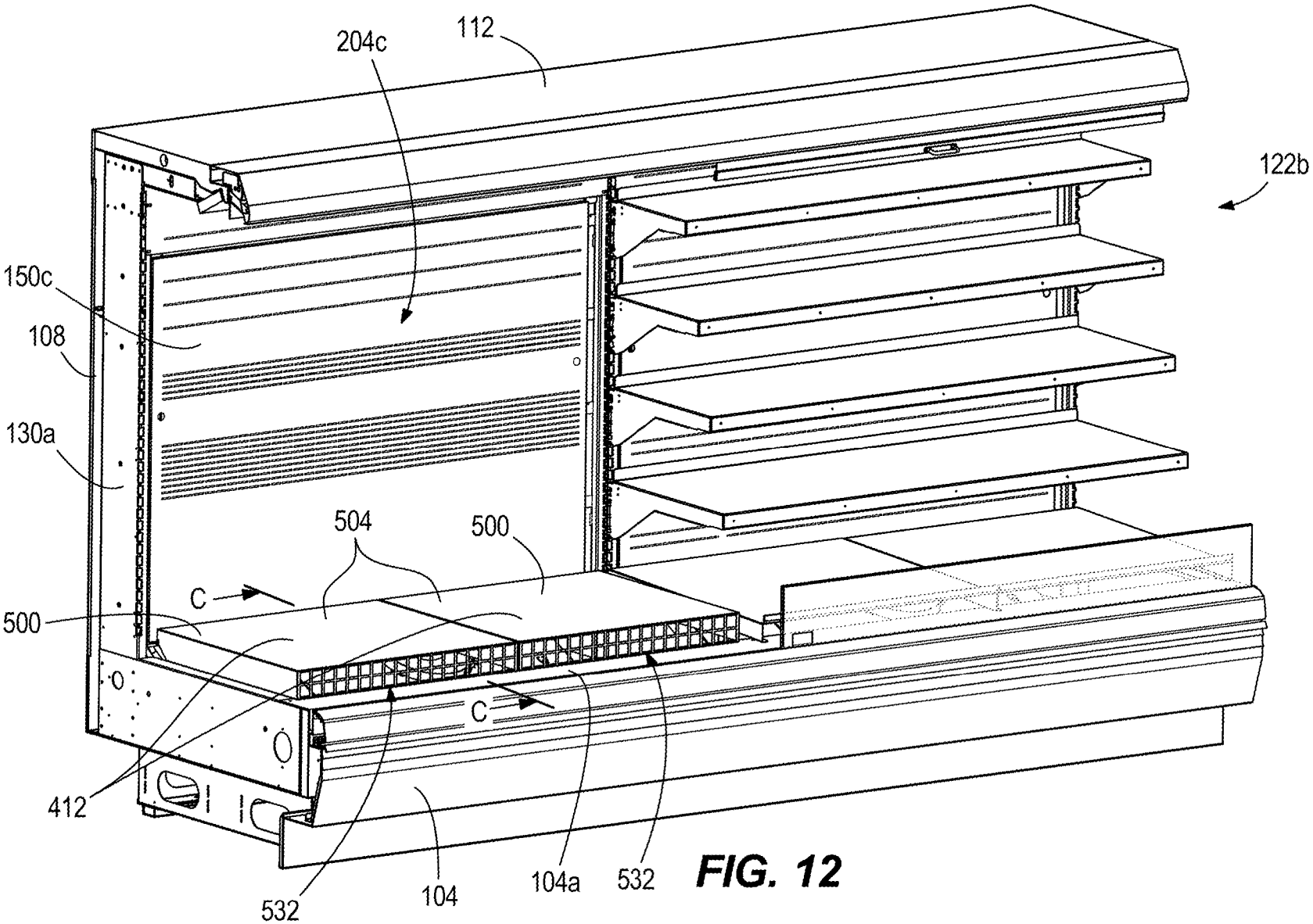
FIG. 12 is a perspective view of the case of FIG. 11 with the lower panels coupled to the rear panel of FIG. 6 and the base with the side panels removed for clarity.
Figure 13:
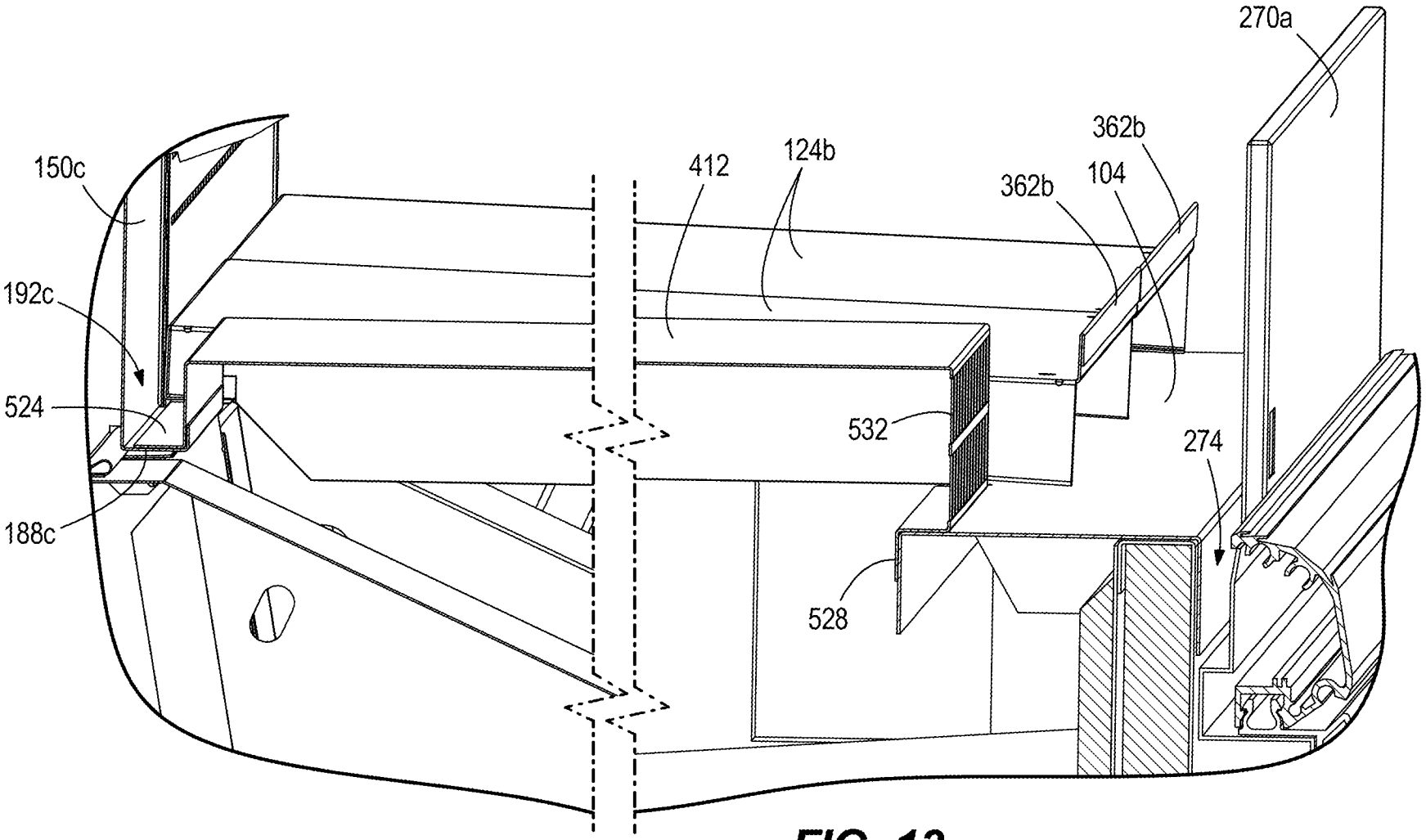
FIG. 13 is a cross-section view illustrating the lower panels of FIG. 12 during assembly and taken along the line C-C of FIG. 12.
Figure 14:
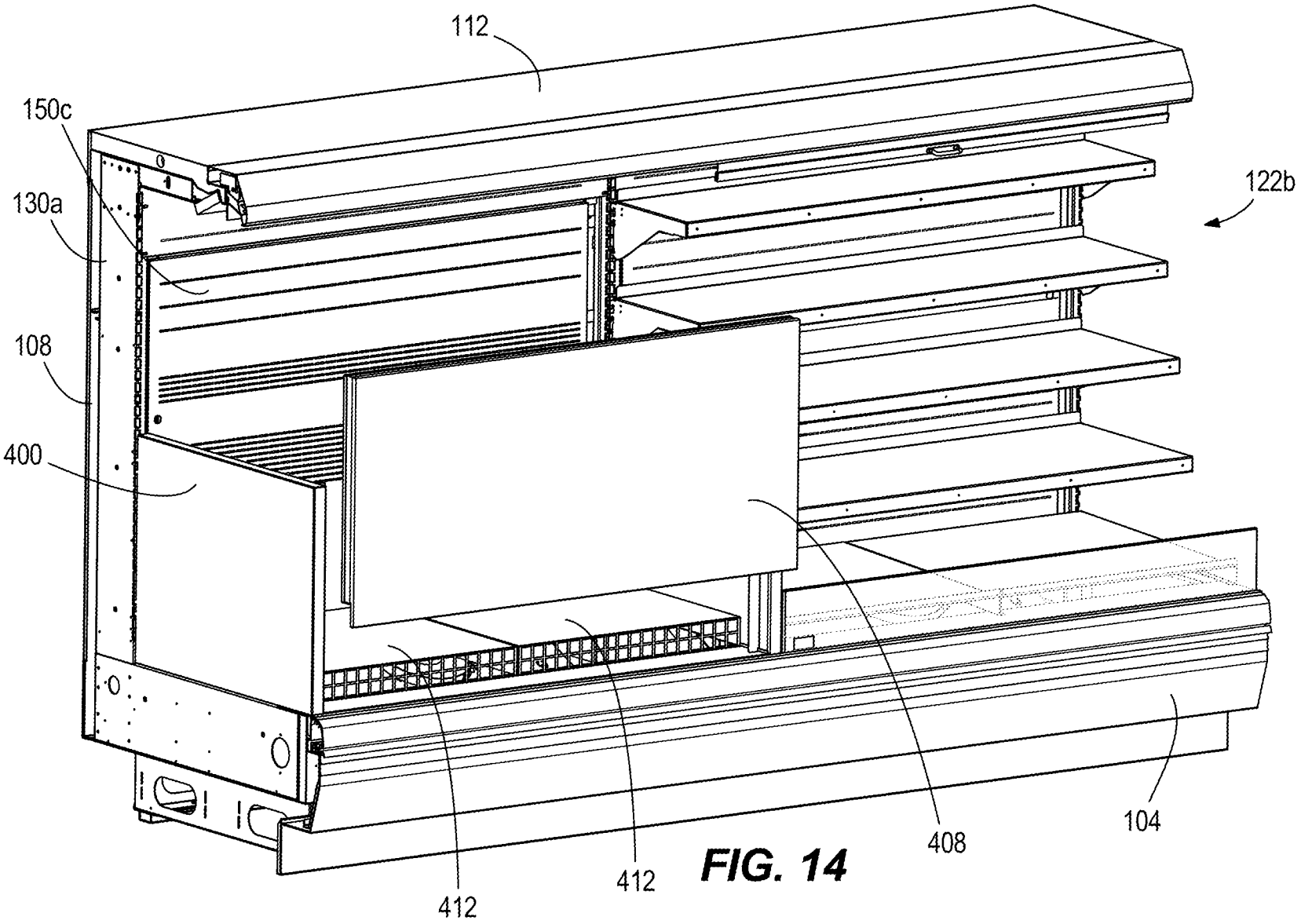
FIG. 14 is a perspective view of the case of FIG. 1A illustrating a fourth step of the conversion of the first refrigerated section to the third product display arrangement of FIG. 1B including coupling a front panel to the base.
Figure 15:
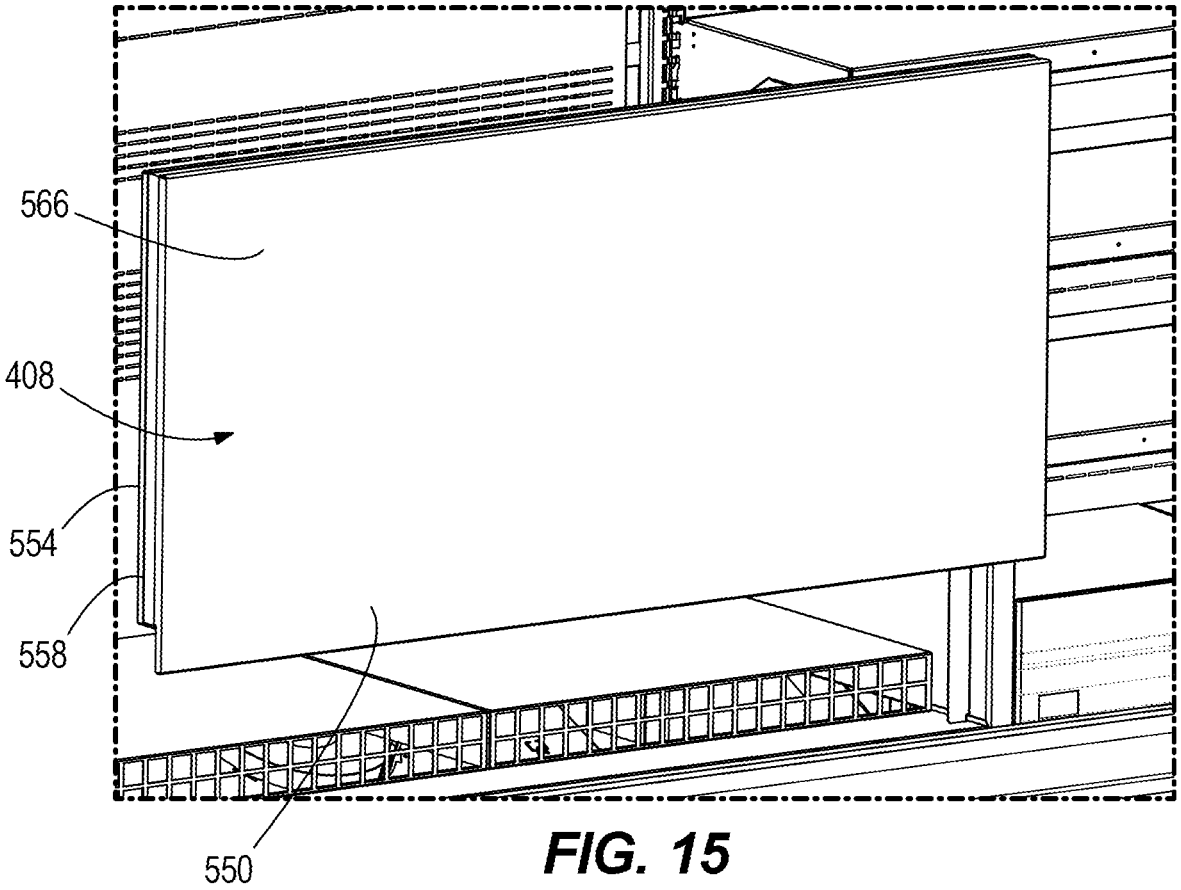
FIG. 15 is an enlarged perspective view the front panel of FIG. 14.
Figure 16:
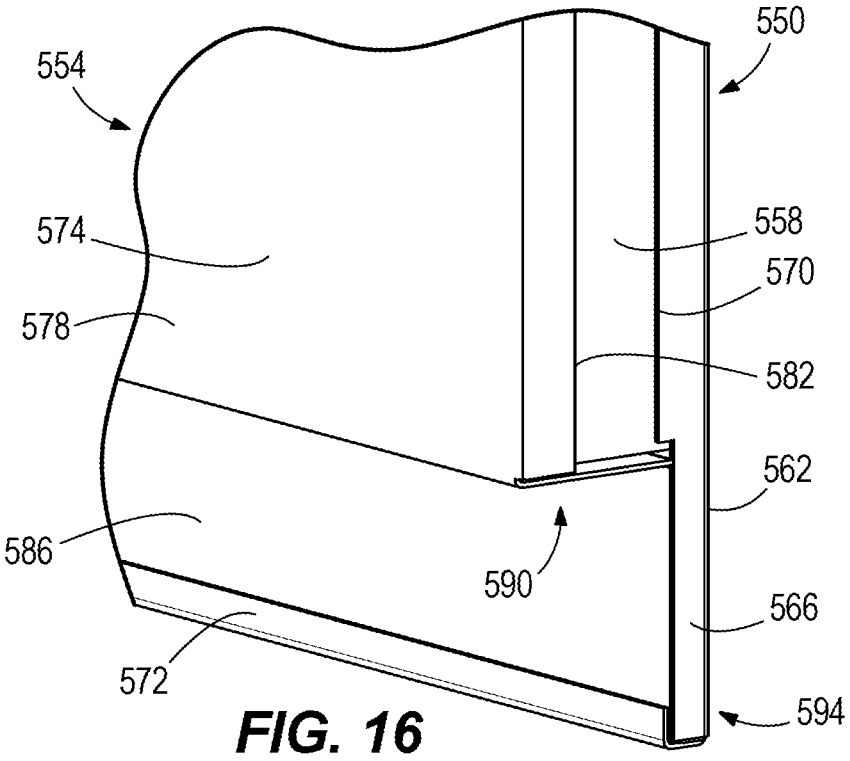
FIG. 16 is an enlarged perspective view of a portion of the front panel.
Figure 17:
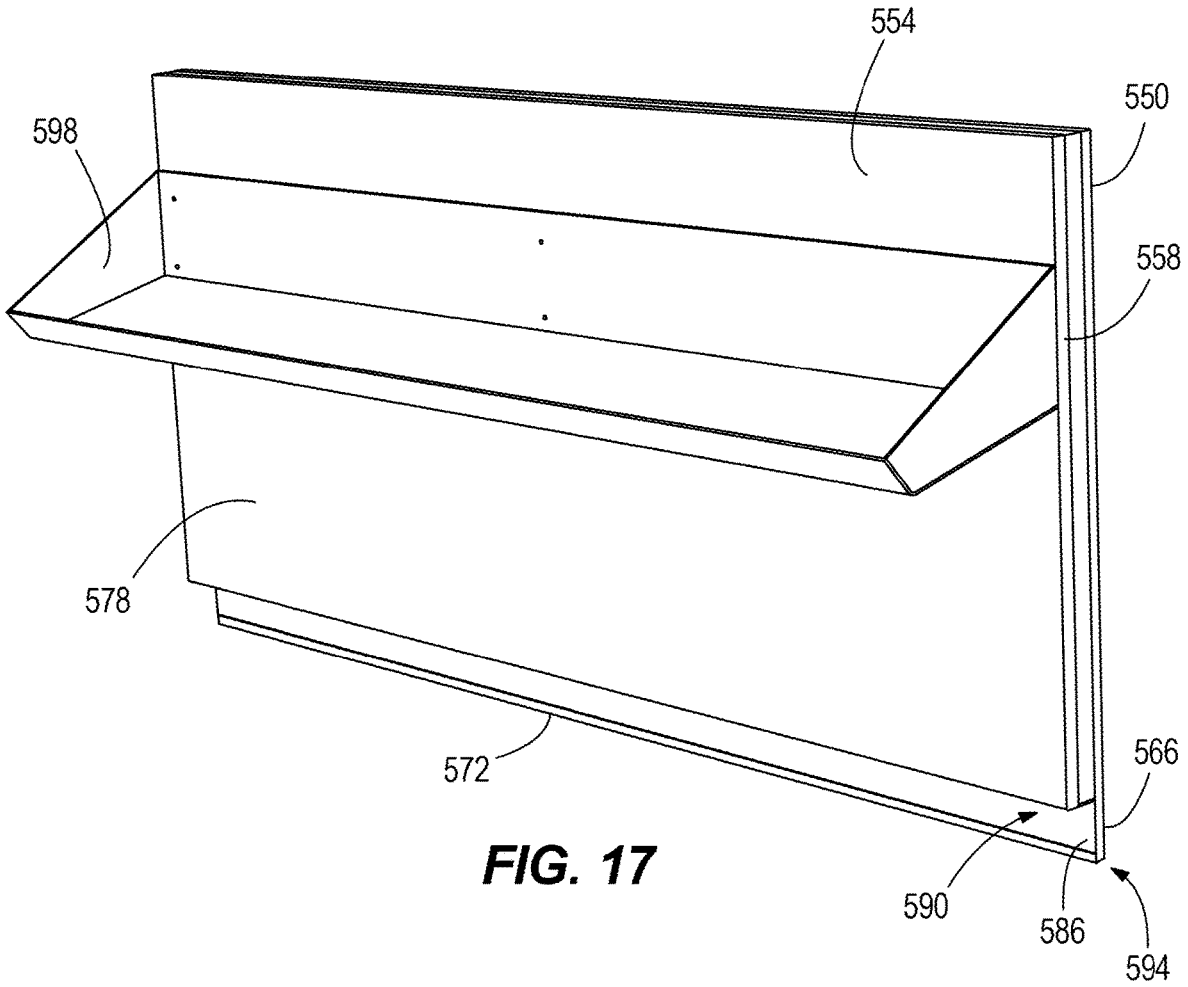
FIG. 17 is a rear perspective view of the front panel of FIGS. 14 and 15 illustrating a tray attached to the front panel.
Figure 25:
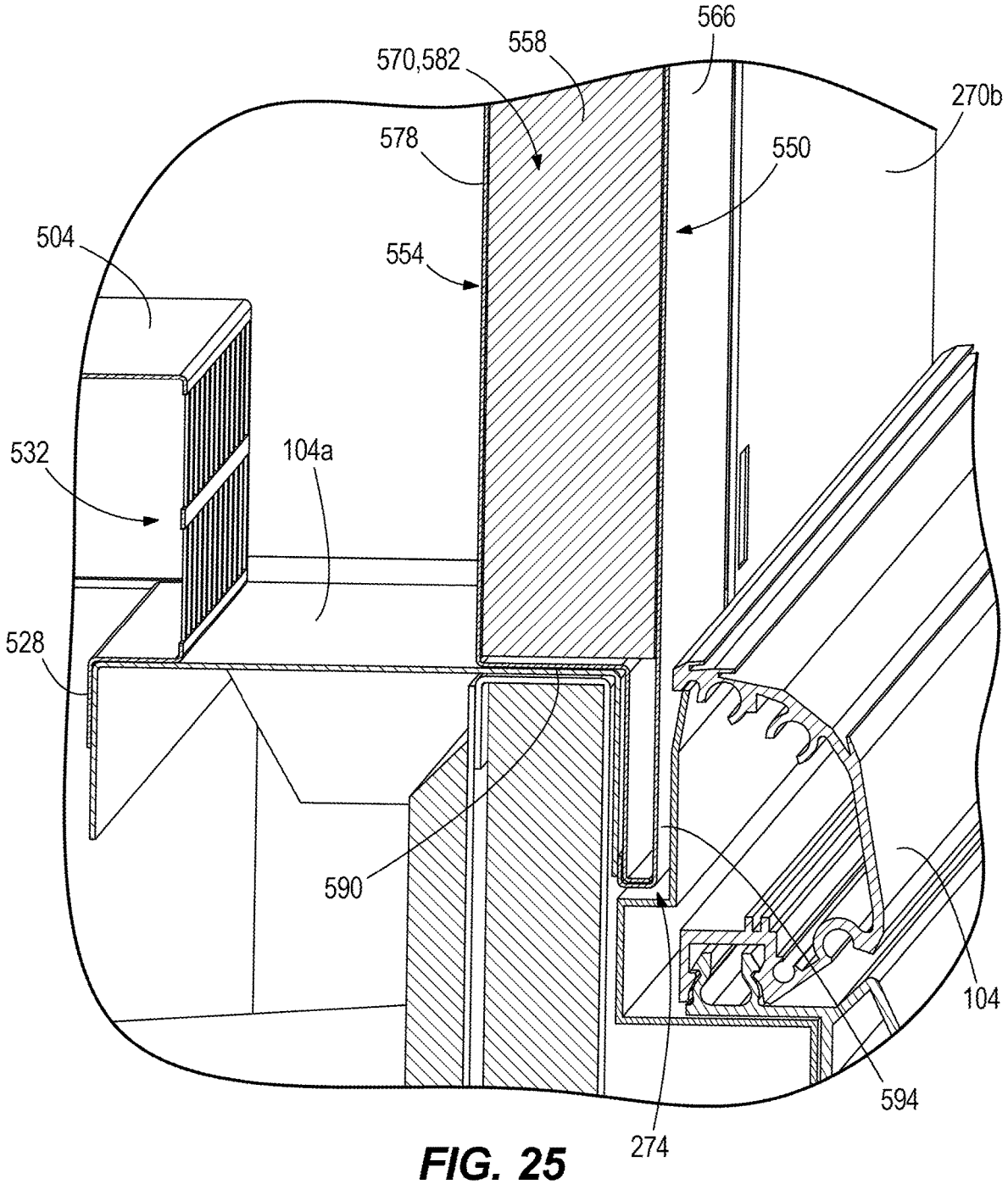
FIG. 25 is an enlarged cross-section view of the case of FIG. 1B along the line E-E of FIG. 18.
Figure 26:
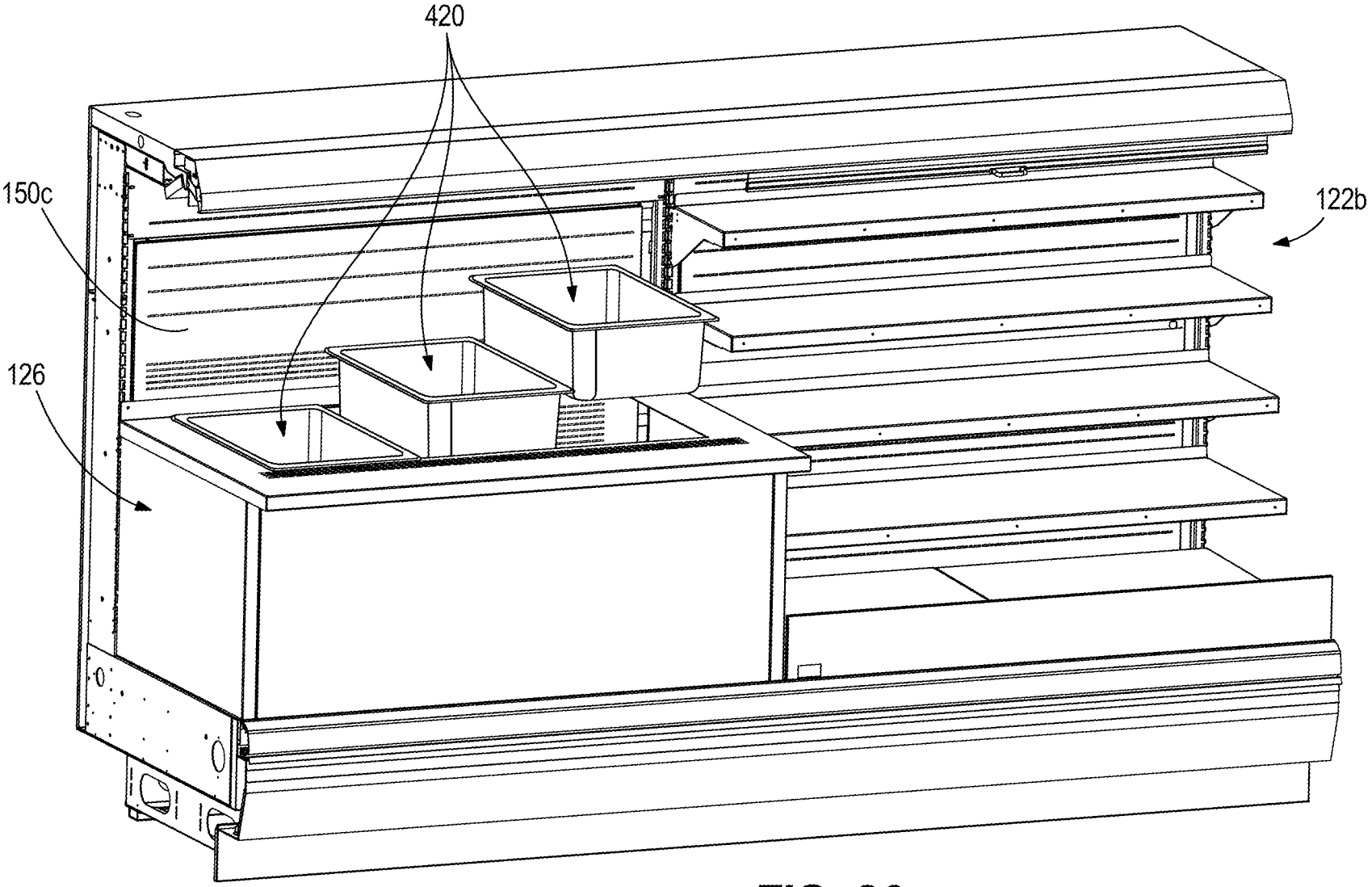
FIG. 26 is a perspective view of the case of FIG. 1A illustrating a sixth step of the conversion of the first refrigerated section to the third product display arrangement of FIG. 1B including positioning food pans in the countertop.

As shown in FIGS. 11-13, the lower panels 412 (also called baffle pans) are positioned between the first and second side panels 400, 404 and are supported by the third rear panel 150*c* and the base 104. In the illustrated construction there are two lower panels 412. In other constructions, there may be a single lower panel 412 or more than two lower panels 412. As shown, each of the lower panels 412 includes a body 500 that has a first wall or support wall 504, a plurality of side walls 505 extending form the support wall 504, a first flange 524 extending from one of the side walls 505 (e.g., a rear side wall), a second flange 528 extending from another of the sidewalls 505 (e.g., a front side wall), and a plurality of apertures 532 extending through the front side wall 505. As shown, the first flange 524 is spaced apart from and below the support wall 504. The first flange 524 is configured to be received in the channel 192*c* of the flange 188*c* of the third rear panel 150*c* such that a wall of the body 500 abuts a wall of flange 188*a*. The second flange 528 positioned below the support wall 504. In the illustrated construction, the second flange 528 is generally L-shaped. Each of the lower panels 412 is supported by the base 104. More specifically, a first portion of the second flange 528 rests on the base 104 (e.g., on the ledge 104*a*), and a second portion of the second flange 528 extends downward into the base 104 and abuts a rearward-facing wall 529 of the base 104. As best shown in FIG. 25, the apertures 532 are located adjacent the second flange 528 (toward a front of the base 104). As shown, the lower panels 412 are supported by and extend between the third rear panel 150*c* and the base 104. When assembled, a gap 530 exists between the lower panels 412 and a front of the base 104 (FIG. 13). Specifically, as shown in FIG. 25, the gap 530 exists between the front panel 408 and the second flanges 486 of the first and second side panels 400, 404. The support wall 504 of the lower panels 412 provide a platform for refrigerated backstock and the apertures 532 direct return airflow 250*a* into each lower panel 412. The airflow 250*a* exits the lower panels 412 into the first lower duct 224, as discussed above.

With reference to FIGS. 14-17 and 25, the front panel 408 is an insulated panel that is supported by the base 104 between the first and second side panels 400, 404. The front panel 408 is formed of three pieces in the illustrated construction. The front panel 408 includes a first portion 550 (e.g., an outer portion), a second portion 554 (e.g., an inner portion) that is coupled to the first portion 550, and a third portion 558 (e.g., an insulative portion) that is disposed between the first portion 550 and the second portion 554. In the illustrated construction, the third portion 558 is formed from foam and therefore defines a foam slab. In other constructions, the third portion 558 may be formed from other insulative materials in lieu of or in addition to foam. In other constructions, the third portion 558 may be omitted such that the front panel 408 may be uninsulated panels.

The first portion 550 includes a rectangular body 562 that defines a first or outer wall 566 and one or more side walls 567 that extend from the outer wall 566. In the illustrated construction, there are four side walls 567, but in other constructions the body 562 may have other configurations. One of the side walls 567 (e.g., a lower side wall) has a flange 572 extending therefrom. Collectively, the outer wall 566, the side walls 567, and the flange 572 define a recess 570, which receives the third portion 558. The second portion 554 includes a generally rectangular body 574 that defines a second or inner wall 578 and one or more side walls 579 extending from the inner wall 578. In the illustrated construction, there are four side walls 579, but in other constructions the body 574 may have other configurations. Collectively, the inner wall 566 and the side walls 579 define a recess 582. One of the side walls 579 (e.g., a lower side wall) has a flange 586 extending therefrom. The inner wall 578 of the second portion 554 is spaced apart from the outer wall 566 of the first portion 550 and the recesses 570, 582 are positioned adjacent to one another. The third portion 558 is positioned between the first portion 550 and the second portion 554 within the recesses 570, 582. The flange 586 of the second portion 554 is configured to be seated in a portion of the recess 570 and is configured to abut the flange 572 of the first portion 550. The lower side wall 579 of the body 574 of the second portion 554 defines a ledge 590, while the flange 586 of the second portion 554 and a lower portion of the first portion 550 collectively define a projection. The projection 594 is configured to be seated in the recess 274 in the base 104 that formerly received the first vertical member 270*a* and the ledge 590 of the second portion 554 abuts the base 104 (e.g., the ledge 104*a*). Additionally, the inner wall 578 of the second portion 554 abuts the second flanges 486 of the first and second side panel 400, 404 thereby preventing inward movement of the front panel and sealing the third portions 458 of each of the first and second side panels 400, 404. In the illustrated construction, a crumb tray 598 is coupled (e.g., by fasteners or a bridge/lance) to the inner wall 578 of the second portion 554.

With reference to FIGS. 19-24, the countertop assembly 416 includes a countertop 610, an insulative member 614, and a cover 618 that, together with the countertop 610, encloses the insulative member 614. The countertop 610 includes a generally rectangular body 626 with a top wall 630 and one or more side walls 631 extending from the top wall 630. A front flange 632 extends from one of the side walls 631 (e.g., a front side wall). A recess 634 is defined by the top wall 630, the side walls 631, and the flange 632. The top wall 630 includes an opening 636 extending therethrough. As shown, the food pans 420 are also included in the countertop assembly 416 and are positioned within the opening 636 and supported by edges of the top wall 630 that define the opening 636.

The body 626 is configured to be positioned on and supported by the first side panel 400, the second side panel 404, and the front panel 408. Specifically, the first side panel 400, the second side panel 404, and the front panel 408 are positioned within and sealed relative to the side walls 631. A rear flange 638 extends from a rear edge of the top wall 630 and includes holes 642 on opposite sides that align with holes (not shown) in the respective first and second vertical support members 130*a*, 130*b*. The aligned holes 642 may receive fasteners (not shown) therethrough to couple the countertop 610 to the rear wall 108. The fastener may be secured without tools. In some embodiments, the countertop 610 may be coupled to the rear wall 108 without fasteners and without tools. A front portion of the body 626 extends beyond the front panel 408. In the illustrated embodiment, the front portion includes a portion of the top wall 630, the front side wall 631, and the flange 632. The front portion supports the insulative member 614 (e.g., a foam slab or other insulative material) within a portion of the recess 634 and the cover 618 is coupled to the front portion (e.g., the flange 632). Together, the countertop 610, the cover 618, and the front panel 408 cooperate to enclose the insulative member 614. A plurality of apertures 646 (e.g., a grill) extends through the top wall 630 between the front portion and the opening 636. The crumb tray 598 is configured to be positioned below the grill 646, catches return grill debris, and is easily accessible, as will be discussed below. As shown, the front panel 408 is seated within the recess 634 between the grill 646 and the front portion. The outer wall 566 of the first portion 550 of the front panel 408 abuts the insulative member 614 of the front portion of the countertop 610. The insulated front portion isolates the grill and the product within the first air curtain 260*a*. Additionally, the front panel 408 is locked-in by a front portion of the countertop 610, the insulative member 614, and the second flanges 486 of the first and second side panels 400, 404. Moreover, the front panel 408 and side panels 400, 404 engage with and may seal to the bottom of countertop 610.

In the illustrated construction, the third product display arrangement 122*c* includes a guard 128 (e.g., a sneeze guard) that is supported by the rear wall 108 (e.g., the first and second vertical support members 130*a*, 130*b*) and suspended above the counter assembly 126. The guard 128 includes a frame 654 that defines an opening 666 and that supports a transparent portion 670 (e.g., a glass portion, window, etc.) over a portion of the opening 666. Accordingly, a portion of the opening 666 remains open to receive the refrigerated air of the first air curtain 260*a* for refrigerating the product in the food pans 420. The frame 654 includes one or more hooks or projections 674, 678 extending from opposite sides thereof. Each of the hooks 674, 678 are cooperatively received in one or more corresponding apertures 138*a*, 138*b* in respective vertical support member 130*a*, 130*b* such that the vertical support members 130*a*, 130*b* support the guard 128 relative to the rear wall 108 and product display area 116.

In the illustrated construction, the first airflow 250*a* in the first rear duct 154*a* is guided to the food pans 420 above and below the countertop 610 via the third configuration of the apertures 204*c* in the third rear panel 150*c*. Accordingly, the third configuration of apertures 204*c* includes rows of apertures 204*c* that extend across a width of the third rear panel 150*c* in the top two-thirds of the third rear panel 150*c*. In the illustrated construction, some of the rows are positioned below the countertop 610 to provide the first airflow 250*a* below the countertop 610 and some of the rows are positioned above the countertop 610. For example, the rows below the countertop 610 direct (e.g., a portion of the first airflow 250*a* along and/or under the pans 420), and the rows above the countertop 610 direct another portion of the first airflow 250*a* across the top of the countertop 610. The differences between the first product display arrangement 122*a* and the third product display arrangement 122*c*, in part, mean that the first airflow 250*a* is guided along one or more different airflow paths based on which of the first product display arrangement 122*a* and the third product display arrangement 122*c* is in use. As an example, the first airflow 250*a* is guided along the first airflow path (as noted above relative to FIG. 1A) to the product when the first product display arrangement 122*a* is installed in the merchandiser 10, and the first airflow 250*a* is guided along a third airflow path to the product when the third product display arrangement 122*c* is installed in the merchandiser 10. In this example, the first flow path and the third airflow path are different.

The refrigerated merchandiser of FIG. 1A having the first configuration including the first product display arrangement 122*a* (e.g., the first column of shelves 124*a*) and the second product display arrangement 122*b* (e.g., the second column of shelves 124*b*) may be converted quickly and easily to the refrigerated merchandiser of FIG. 1B having the second configuration with the second product display arrangement 122*b* (e.g., a single column of shelves 124*b*) and the third product display arrangement 122*c* (e.g., the counter assembly 126 and the guard 128). To this end, a user need only remove the first column of shelves 124*a* and the first rear panel 150*a* from the rear wall 108 (e.g., first and second vertical support members 130*a*, 130*b*). The shelves 124*a* are coupled to the rear wall 108 without fasteners and without tools. More specifically, the suspended shelves 124*a* engage the rear wall 108 via a fit and clip arrangement between respective hooks of the shelves 124*a* and apertures 138*a*, 138*b* of the vertical support members 130*a*, 130*b*. With reference to FIGS. 1A and 4A, the lowermost shelves 124*a* are supported, without fasteners, between the flange 188*a* of the rear wall 150*a* and the base 104. Accordingly, a user may remove the suspended shelves 124*a* by simply removing the hooks from the corresponding apertures 138*a*, 138*b* of the vertical support members 130*a*, 130*b*, and/or pulling the lowermost shelves 124*a* off the merchandiser 10.

With reference to FIGS. 4C and 4D, the rear panel 150*a* is coupled to the rear wall 108 without threaded or rivet-type fasteners and without tools. More specifically, the projections 196*a*, 200*a* of the rear panel 150*a* are engageable with the respective apertures 144*a*, 144*b* of the respective vertical support members 130*a*, 130*b*. Accordingly, a user may remove the rear panel 150*a* by disengaging the projections 196*a*, 200*a* thereof from the corresponding vertical support member 130*a*, 130*b*. A user may change the rear panel 150*a* by attaching the third rear panel 150*c* to the rear wall 108 (e.g., the first and second vertical support members 130*a*, 130*b*) before assembling the counter assembly 126 and the guard 150 as described herein. Like the rear panel 150*a*, the rear panel 150*c* is coupled to the rear wall 108 via engagement between the projections 196*c*, 200*c* and apertures 144*a*, 144*b* of the vertical support members 130*a*, 130*b*. The lower panels 412 are supported, without fasteners, between the flange 188*a* and the base 104.

Figure 18:
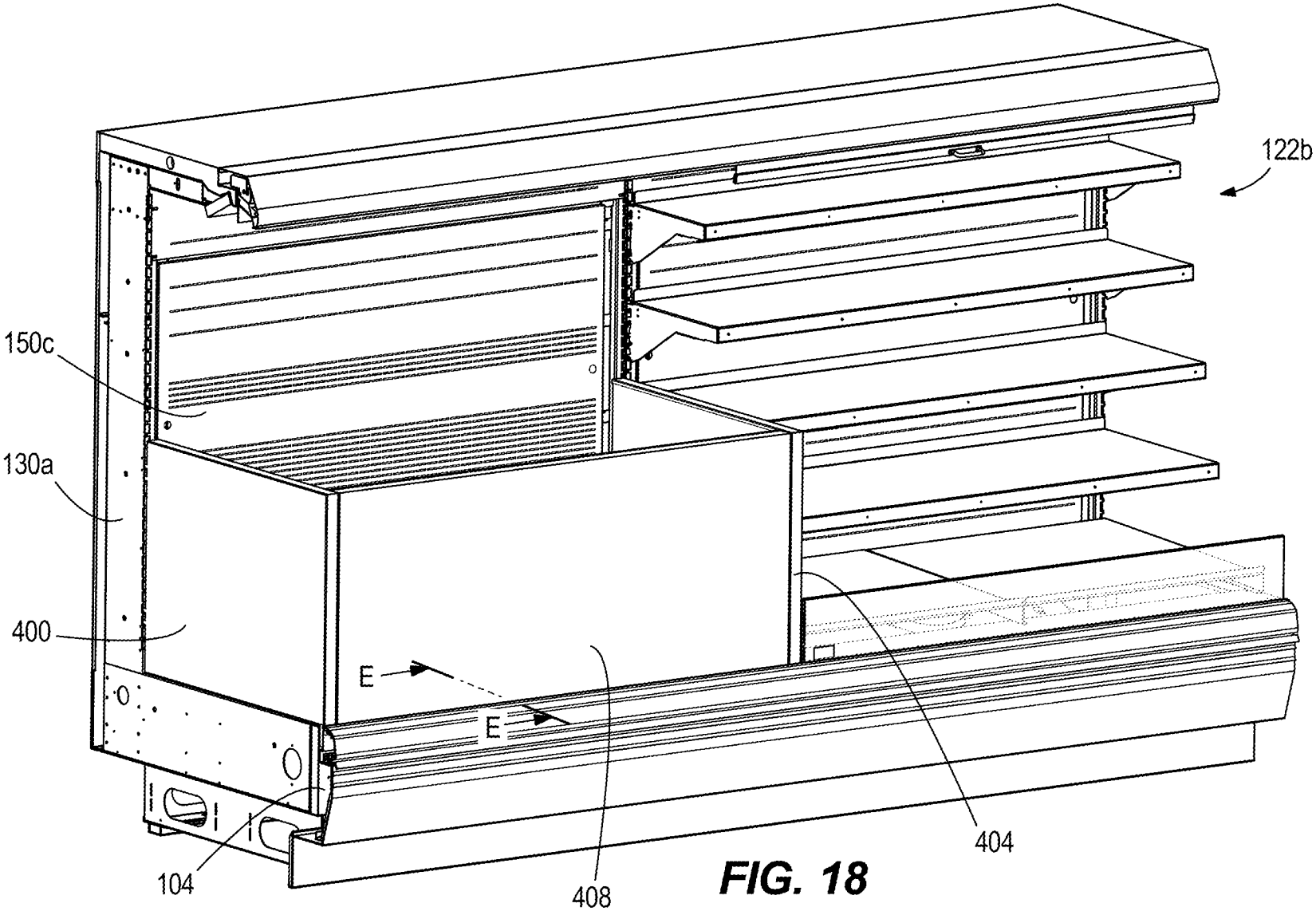
FIG. 18 is a perspective view of the case illustrating the side panels and the front panel coupled to the case.
Figure 19:
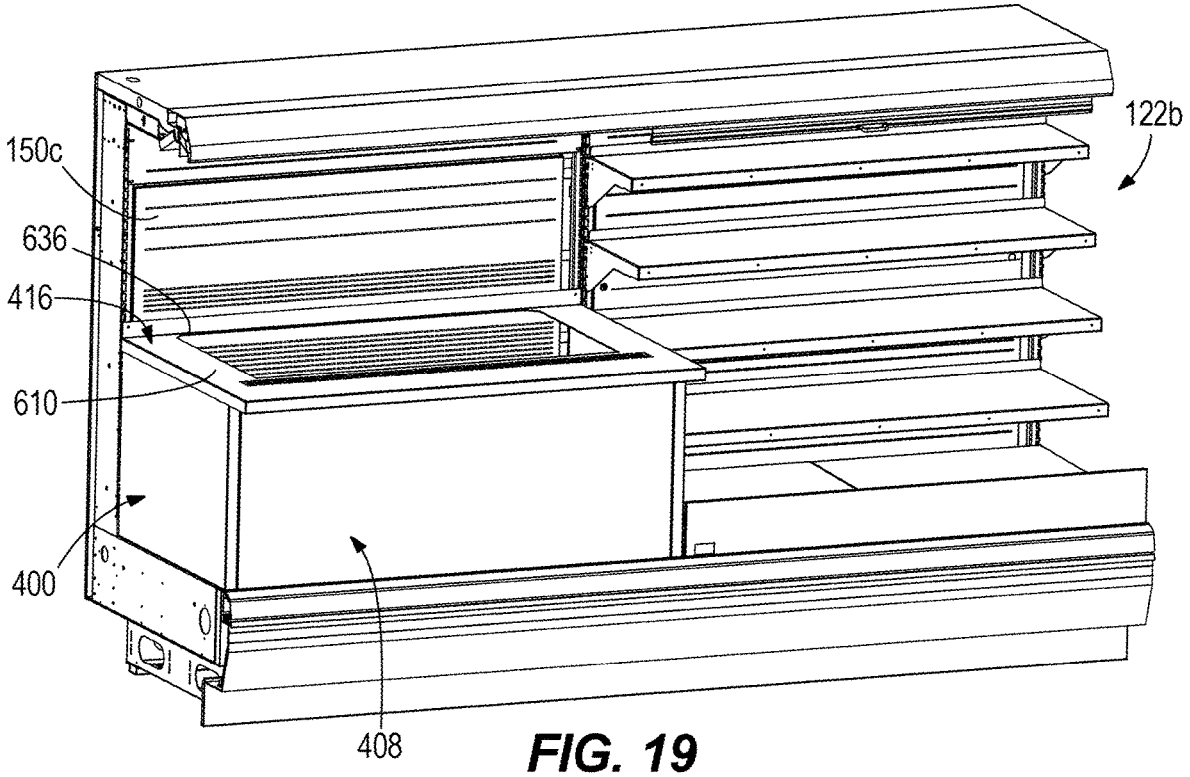
FIG. 19 is a perspective view of the case of FIG. 1A illustrating a fifth step of the conversion of the first refrigerated section to the third product display arrangement of FIG. 1B including coupling a countertop to the rear wall, the side panels, and the front panel.
Figure 20:
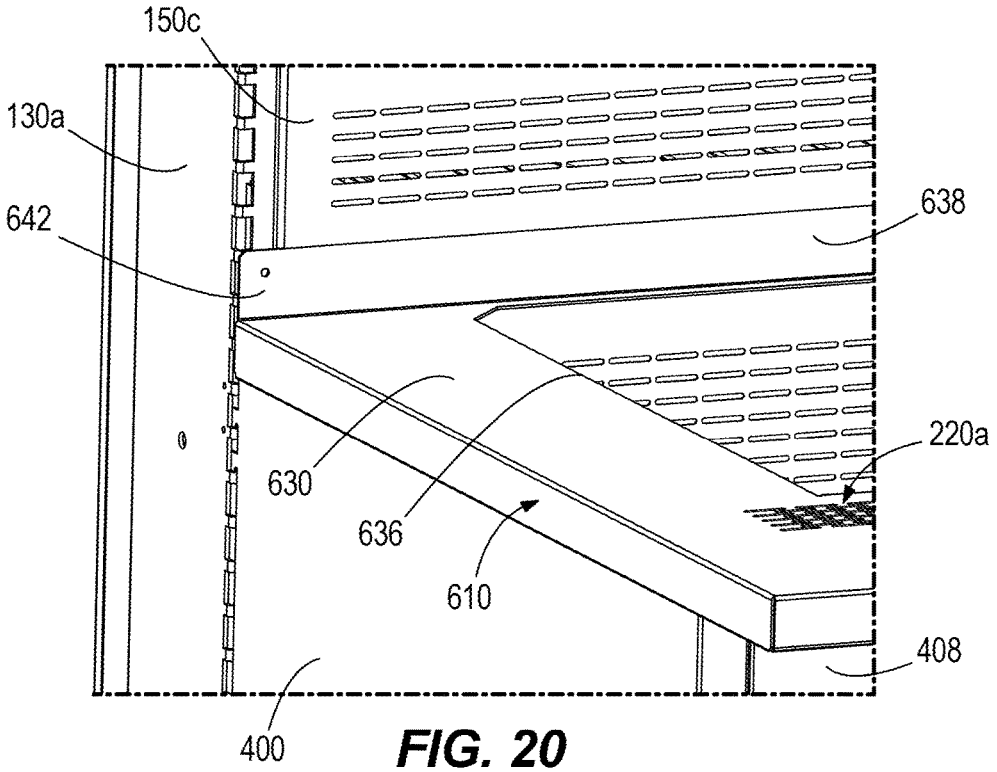
FIG. 20 is an enlarged perspective view of a portion of the countertop of FIG. 19.
Figure 21:
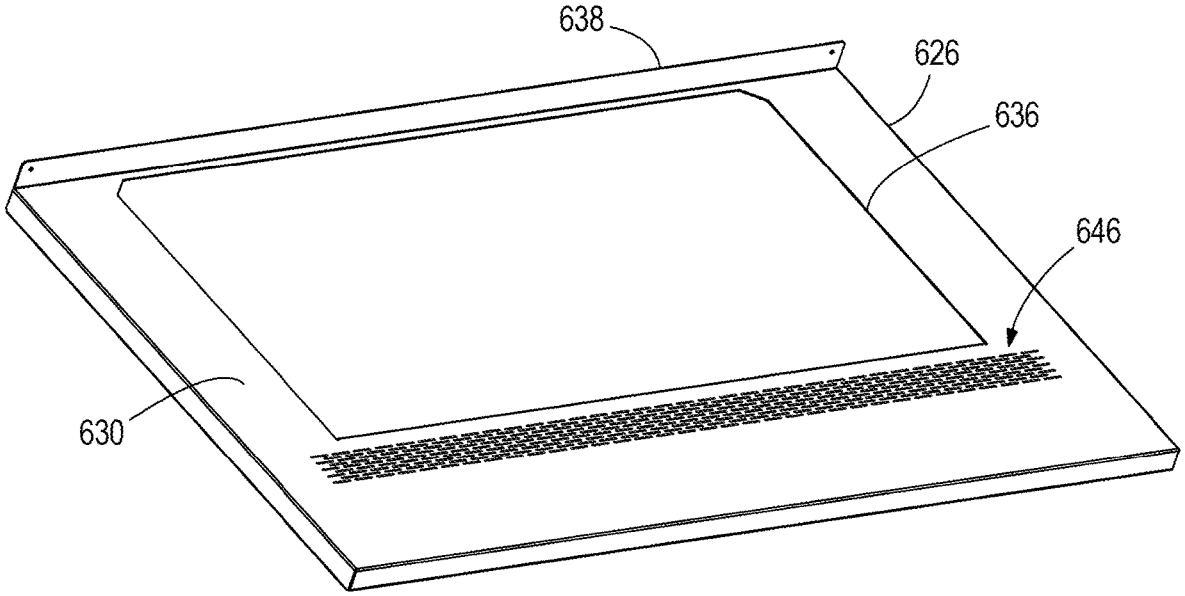
FIG. 21 is an upper perspective view of the countertop of FIG. 19 illustrating inlet apertures in the front rail.
Figure 22:
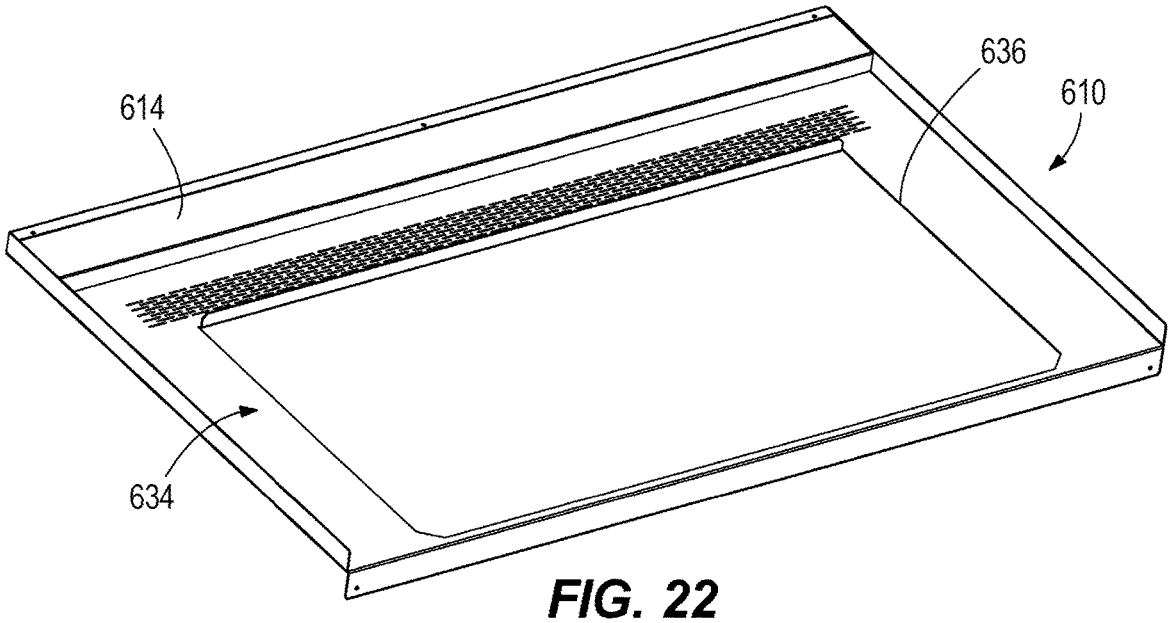
FIG. 22 is a lower perspective view of the countertop of FIG. 19 illustrating insulation under a front rail of the countertop.
Figure 23:
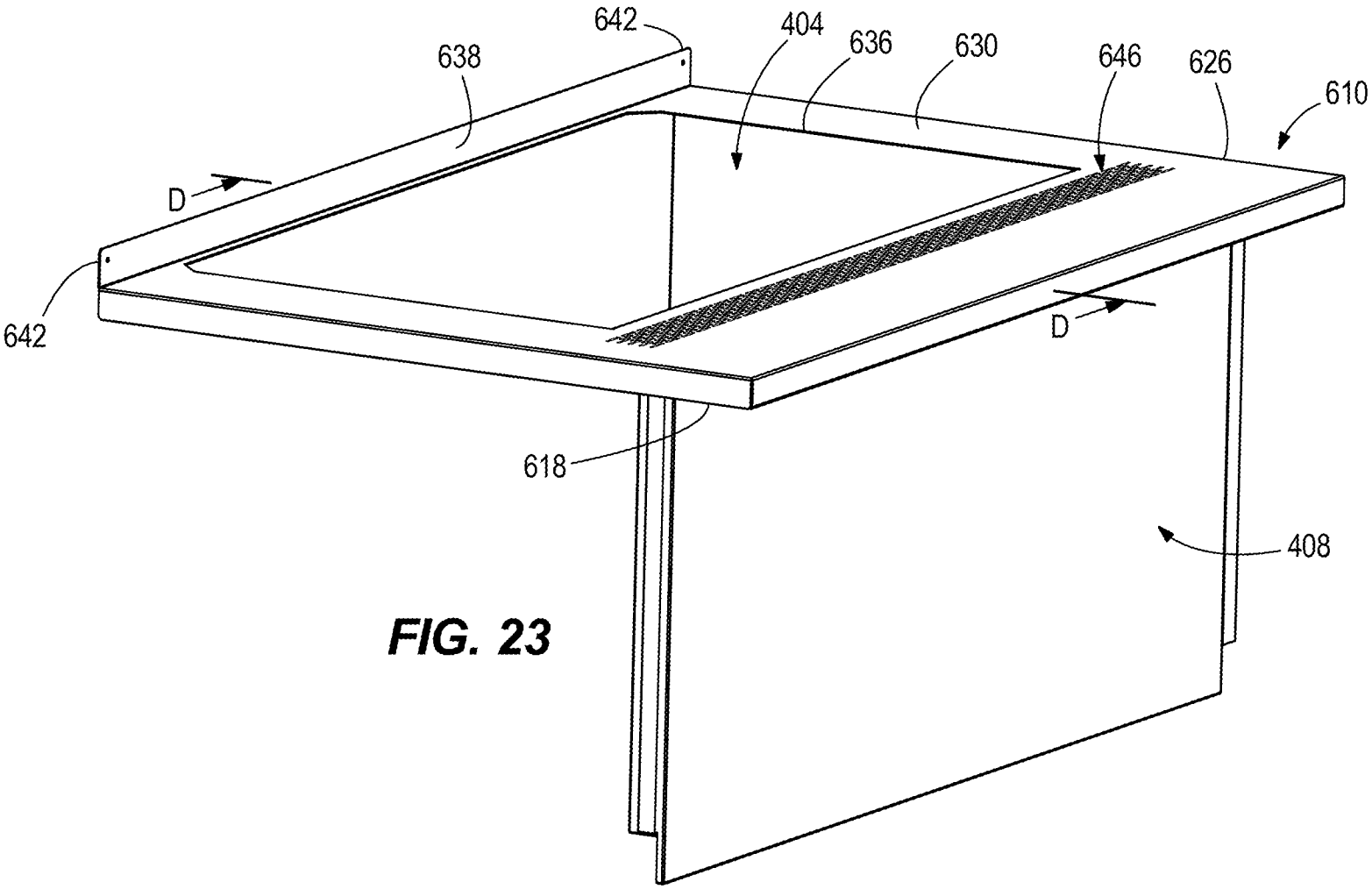
FIG. 23 is a perspective view of the countertop of FIG. 19 relative to the front panel.
Figure 24:
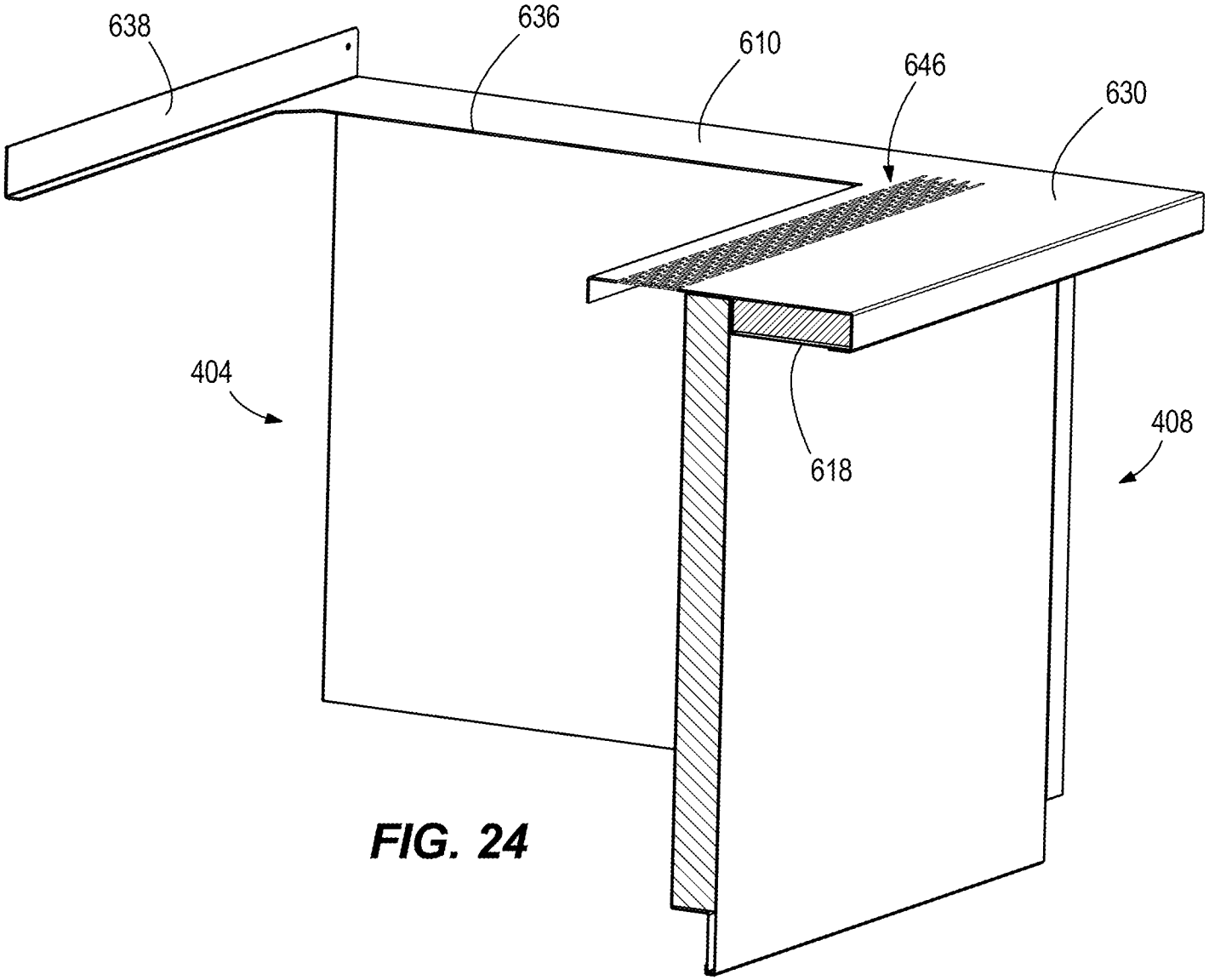
FIG. 24 is a cross-section view of the countertop and front panel of FIG. 23 without the tray and taken along the line D-D of FIG. 23.
Figure 27A:
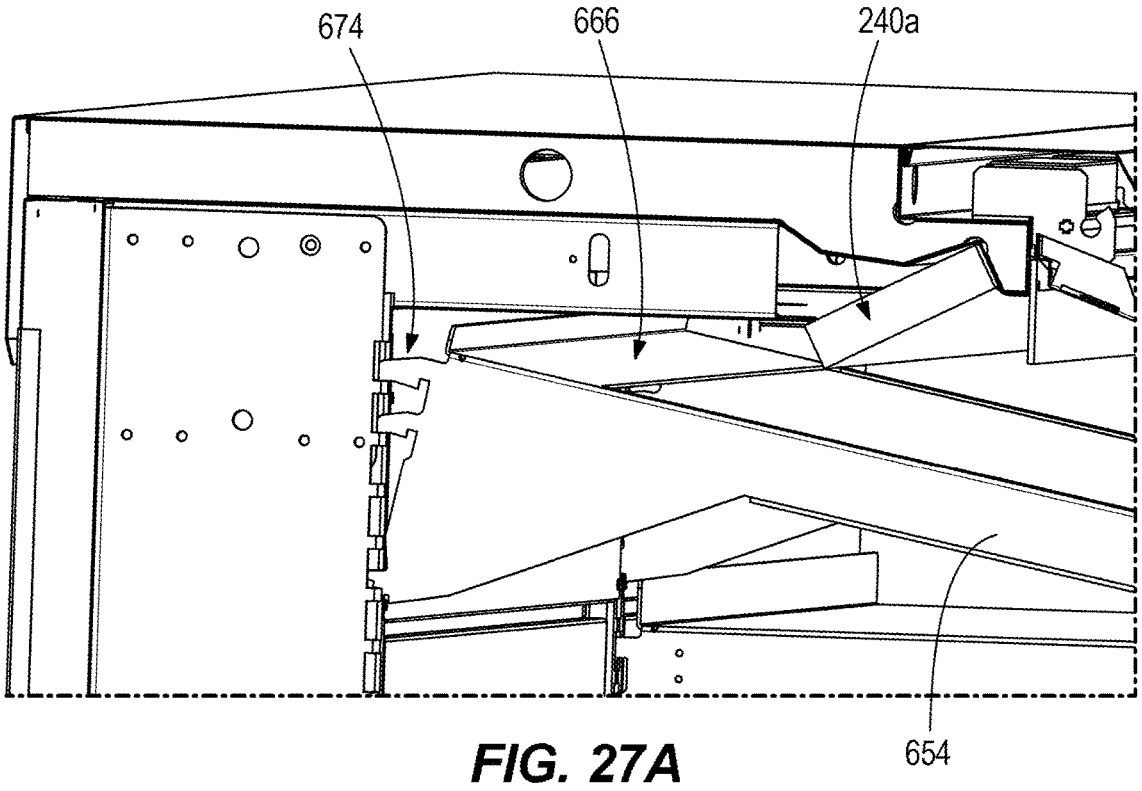
FIG. 27A is a perspective view of the case of FIG. 1A illustrating a seventh step of the conversion of the first refrigerated section to the third product display arrangement of FIG. 1B including coupling a guard to the rear wall.
Figure 27B:
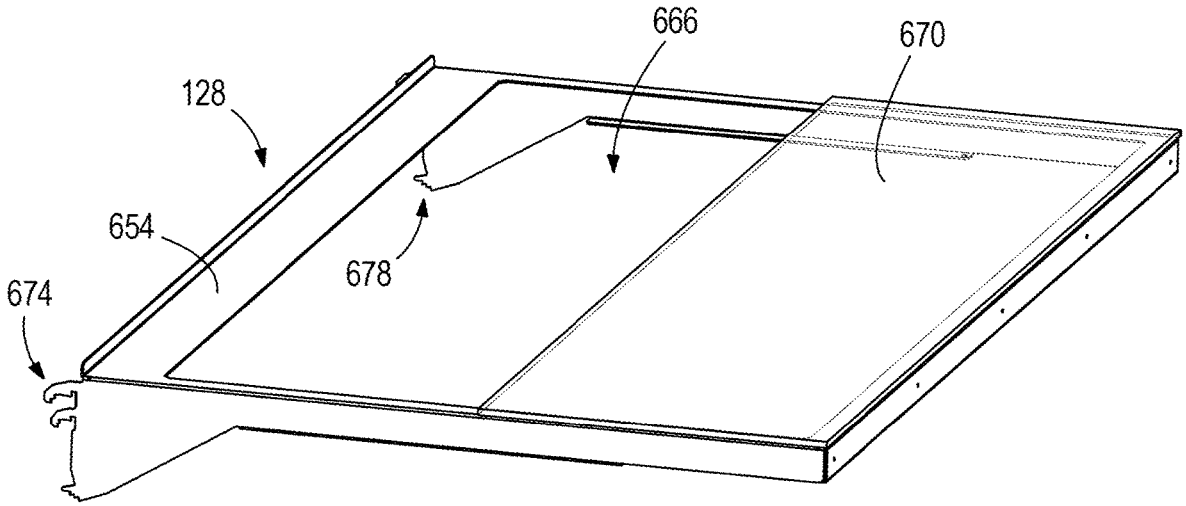
FIG. 27B is a perspective view of the guard of FIG. 1B and FIG. 27A.

With reference primarily to FIGS. 18 and 27A, the panels 400, 404 and the guard 128 are coupled to the rear wall 108 without threaded or rivet-type fasteners and without tools. More specifically, the panels 400, 404 and the guard 128 are supported by the rear wall 108 via hooks 474, 674 that are received in corresponding apertures 138*a*, 138*b* of the vertical support members 130*a*, 130*b*. Moreover, the panel 408 is coupled to the base 104 without fasteners and without tools. As shown, the panel 408 is supported, without fasteners, by the base 104 between the panels 400, 404. The countertop assembly 416 is supported by the panels 400, 404, 408 and the rear wall 108. In the illustrated construction, the countertop 610 includes a fastener to secure the countertop 610 to and prevent improper removal from the rear wall 108. In some constructions, the countertop 610 may be secured to the merchandiser 10 in other ways that do not include a fastener and do not involve tools.

The components of the case 100 and the first refrigeration system 214*a* can be used to support both configurations without having to use threaded fasteners or rivets (or similar fasteners necessitating the use of tools) for attachment of components to the case 100 and removal of components from the case 100. That is, the components of each of the first, second, and third product display arrangements 122*a*, 122*b*, 122*c* are attachable to and removable from the merchandiser 10 without threaded fasteners such that the user can easily interchange the merchandiser 10 between a variety of configurations. In this way, the case structure of the merchandiser 10 can be used to define different merchandising capability and different airflow paths based on the variety of configurations such that the same refrigeration system (e.g., the first and second refrigerated sections 210*a*, 210*b*) may be used to direct conditioned airflow to product supported by the various configurations. For purposes of the claims, the phrase "without fasteners" means that screws, bolts, rivets, or other fasteners that necessitate a tool for installation or removal. The phrase "without tools" means that conventional tools (e.g., screwdrivers, rivet guns, snips, impact drivers, etc.) are not necessary for replacement of one or more product display arrangements in the merchandiser 10.

In the illustrated construction, the refrigerated merchandiser 10 may be manufactured by first forming or assembling the base 104 and the rear wall 108 with the vertical support members 130*a*-130*d* and the rear panels 150*a*-150*c*. Additionally, the method includes operatively coupling a refrigeration system to the merchandiser 10 (e.g., at least partially supported by the base 104 and/or the rear wall 108). The method further includes providing the first product display arrangement 122*a*, the second product display arrangement 122*c*, and the third product display arrangement, each of which can be coupled to the rear wall 108 and supported in either of the refrigerated sections 210, 210*b* as a user sees fit.

Various additional features and advantages of the invention are set forth in the following claims.

The invention claimed is:

1. A refrigerated merchandiser comprising:

a case including a case structure having a base and a rear wall, the case structure defining a product display area;

a refrigeration system supported by the case to condition the product display area;

a first refrigerated section of the case including a first rear panel and a first product display arrangement and positioned in a first portion of the product display area, the first rear panel spaced from the rear wall and partially defining a first duct, the first rear panel including a first plurality of apertures arranged in a first pattern and configured to communicate an airflow from the first duct through the first rear panel into the first portion of the product display area, the refrigeration system in communication with the first portion of the product display area at least partially via the first plurality of apertures to maintain the first portion of the product display area within a predetermined temperature range; and a second refrigerated section including a second rear panel and a second product display arrangement positioned in a second portion of the product display area laterally adjacent the first product display arrangement, the second rear panel spaced from the rear wall and partially defining a second duct, the second rear panel including a second plurality of apertures arranged in a second pattern configured to communicate an airflow from the second duct through the second rear panel into the second portion of the product display area, the refrigeration system in communication with the second portion of the product display area at least partially via the second plurality of apertures to maintain the second portion of the product display area within the predetermined temperature range;

wherein the first product display arrangement has one or more first shelves vertically arranged relative to each other and defining corresponding horizontal support surfaces configured to support product, wherein the second product display arrangement has one or more second shelves or a countertop assembly defining at least one horizontal support surface configured to support product, wherein the case has a first configuration defined by the first product display arrangement and the second product display arrangement, wherein the case has a second configuration different from the first configuration and defined by replacement of one or both of i) the first product display arrangement and the first rear panel and ii) the second product display arrangement and the second rear panel with a third product display arrangement having a product support structure comprising one or both of shelving and the countertop assembly that is different from the replaced product display arrangement such that the shelving of the third product display arrangement is configured to replace the countertop assembly of the second product display arrangement and the countertop assembly of the third product display arrangement is configured to replace the one or more first shelves or the one or more second shelves, wherein the countertop assembly includes a top wall with an opening configured to receive a pan configured to support product therein, wherein the third product display arrangement is at least partially supported by the case via a third rear panel replacing the first rear panel or the second rear panel, the third rear panel having a third plurality of apertures arranged in a third pattern configured to communicate air through the third rear panel, and wherein the third pattern is different from the pattern of the replaced rear panel and is arranged to condition the third product display arrangement.

2. The refrigerated merchandiser of claim 1, wherein each of the first configuration and the second configuration is configured to be assembled onto the case without tools.

3. The refrigerated merchandiser of claim 1, wherein the case structure includes a canopy, wherein the refrigeration system is further in communication with each of the first portion of the product display area and the second portion of the product display area through the canopy.

4. The refrigerated merchandiser of claim 1, wherein the refrigeration system includes one or more fans configured to generate a first airflow toward the first product display arrangement along a first flow path and a second airflow toward the second product display arrangement along a second flow path, and wherein the one or more fans are configured to generate a third airflow to the third product display arrangement along a third flow path that is different from the first flow path and the second flow path.

5. The refrigerated merchandiser of claim 1, wherein:

the case further includes a canopy at least partially defining the product display area along with two of the first rear panel, the second rear panel, and the third rear panel, the first refrigeration section and the second refrigeration section are positioned laterally adjacent each other, the refrigeration system includes a first evaporator in airflow communication with the first refrigerated section and the first product display arrangement along a first flow path through the canopy and the first plurality of apertures of the first rear panel to maintain the product in the first product display arrangement within a first predetermined temperature range, and the refrigeration system further includes a second evaporator in airflow communication with the second refrigerated section and the second product display arrangement along a second flow path through the canopy and the second plurality of apertures of the second rear panel to maintain the product in the second product display arrangement within the first predetermined temperature range, the second evaporator is in airflow communication with the second refrigeration section and the third product display arrangement along a third flow path on replacement of the second product display arrangement having two or more shelves with the third product display arrangement having the countertop assembly, and the third flow path is different from the second flow path and at least partially extends from the canopy into the countertop assembly via an inlet formed in the top wall of the countertop assembly.

6. The refrigerated merchandiser of claim 5, wherein the first product display arrangement is at least partially supported by the first rear panel via hooks without separate fasteners, wherein the second product display arrangement is at least partially supported by the second rear panel via hooks without separate fasteners, and wherein the third product display arrangement is at least partially supported by the third rear panel via hooks without separate fasteners.

7. The refrigerated merchandiser of claim 5, wherein the countertop assembly includes lower panels supported by the third rear panel and the base, and wherein the lower panels are positioned between a first side panel, a second side panel, and a front panel.

8. The refrigerated merchandiser of claim 7, wherein each of the lower panels includes a plurality of apertures extending through a respective first wall of the lower panels, and wherein the plurality of apertures directs a portion of the third flow path through the lower panels and toward a fan assembly of the refrigeration system located in a lower duct formed in the base of the case.

9. The refrigerated merchandiser of claim 1, wherein each of the first rear panel and the second rear panel is removable and replaceable, without tools, by the third rear panel.

10. The refrigerated merchandiser of claim 9, wherein the one or more second shelves of the second product display arrangement are at least partially supported by the second rear panel via hooks without separate fasteners.

11. The refrigerated merchandiser of claim 10, wherein the countertop assembly of the third product display arrangement includes a counter assembly cooperatively supported by the base and the third rear panel.

12. The refrigerated merchandiser of claim 1, wherein the third plurality of apertures includes a set of apertures disposed above the countertop assembly and configured to extend a third flow path across the top of the countertop assembly, and wherein the third plurality of apertures includes a set of apertures disposed below the countertop assembly and configured to extend the third flow path below the pan that is received in the opening.

13. A refrigerated merchandiser comprising:

a case including a base and a rear wall at least partially defining a product display area;

a refrigeration system coupled to the case and in communication with a first portion of the product display area having a first rear panel and a second portion of the product display area having a second rear panel, the refrigeration system including one or more heat exchangers to maintain the first portion of the product display area within a predetermined temperature range and the second portion of the product display area within the predetermined temperature range;

a first shelf coupled to and supported only by the rear wall, and positioned in the first portion of the product display area, the first shelf defining a horizontal support surface configured to support product; and a second shelf coupled to and supported only by the rear wall, and positioned in the second portion of the product display area, the second shelf defining a horizontal support surface configured to support product, wherein either i) the first shelf and the first rear panel or ii) the second shelf and the second rear panel are removable from the case and replaceable with a countertop assembly and a third rear panel cooperatively supported by and attached to the base and the rear wall, wherein the first rear panel is spaced from the rear wall and partially defines a first duct, the first rear panel includes a first plurality of apertures arranged in a first pattern and configured to communicate an airflow from the first duct through the first rear panel into the first portion of the product display area, wherein the second rear panel is spaced from the rear wall and partially defines a second duct, the second rear panel includes a second plurality of apertures arranged in a second pattern configured to communicate an airflow from the second duct through the second rear panel into the second portion of the product display area, wherein the countertop assembly includes a top wall with at least one opening extending therethrough and configured to receive a pan containing product, wherein the third rear panel has a third plurality of apertures arranged in a third pattern configured to communicate air through the third rear panel, and wherein the third pattern is different from the pattern of the replaced rear panel and is arranged to condition the third product display arrangement.

14. The refrigerated merchandiser of claim 13, wherein the refrigeration system further includes a first fan assembly and a first evaporator configured to generate a first refrigerated airflow along a first flow path through the first plurality of apertures in the first rear panel and toward the first shelf, and a second fan assembly and a second evaporator configured to generate a second refrigerated airflow along a second flow path through the second plurality of apertures in the second rear panel and toward the second shelf, and wherein, after removal of the first shelf or the second shelf and installation of the countertop assembly as a replacement of the first shelf or the second shelf, the first refrigerated airflow or the second refrigerated airflow associated with the replaced first shelf or the replaced second shelf, respectively, is guided toward the countertop assembly along a third flow path different from the first flow path or the second flow path.

15. The refrigerated merchandiser of claim 14, wherein the first rear panel or the second rear panel is removable and replaceable, without fasteners that are separate from the first rear panel or the second rear panel and without tools, by the third rear panel.

16. The refrigerated merchandiser of claim 14, wherein the countertop assembly further includes lower panels supported by the rear wall and the base without fasteners that are separate from the lower panels, and wherein the lower panels are positioned between the first side panel, the second side panel, and the front panel.

17. The refrigerated merchandiser of claim 16, wherein each of the lower panels includes a plurality of apertures extending through a respective first wall of the lower panels, and wherein the apertures configured to communicate an airflow from the first product display area or the second product display area through the lower panels and toward a fan assembly of the refrigeration system located in a lower duct formed in the base of the case.

18. The refrigerated merchandiser of claim 14, wherein the third flow path at least partially extends from a canopy into the countertop assembly via an inlet formed in the top wall of the countertop assembly.

19. The refrigerated merchandiser of claim 14, wherein the third plurality of apertures includes a set of apertures disposed above the countertop assembly and configured to extend the third flow path across the top of the countertop assembly, and wherein the third plurality of apertures includes a set of apertures disposed below the countertop assembly and configured to extend the third flow path below the pan received in the opening.

20. The refrigerated merchandiser of claim 13, wherein the countertop assembly includes a first side panel, a second side panel, a front panel, and a countertop configured to support one or more pans, wherein the first side panel and the second side panel are supported by the base and the rear wall with first fasteners and without the use of tools, wherein the front panel is supported by the base, the first side panel, and the second side panel with second fasteners and without the use of tools, and wherein the countertop is supported by the first side panel, the second side panel, and the front panel.

* * * * *